US007621411B2

(12) United States Patent
Doherty et al.

(10) Patent No.: US 7,621,411 B2
(45) Date of Patent: Nov. 24, 2009

(54) APPLICATOR, APPLICATOR CAP AND A CONTAINER HAVING AN APPLICATOR CAP

(75) Inventors: Michael A. Doherty, Mayo (IE); Geoffrey F. Seymour, Wicklow (IE)

(73) Assignee: Locite (R&D) Limited, Dublin (IE)

( * ) Notice: Subject to any disclaimer, the term of this patent is extended or adjusted under 35 U.S.C. 154(b) by 0 days.

(21) Appl. No.: 10/182,824

(22) PCT Filed: Feb. 7, 2001

(86) PCT No.: PCT/IE01/00018

§ 371 (c)(1),
(2), (4) Date: Aug. 2, 2002

(87) PCT Pub. No.: WO01/56894

PCT Pub. Date: Aug. 9, 2001

(65) Prior Publication Data

US 2003/0034322 A1 Feb. 20, 2003

(30) Foreign Application Priority Data

Feb. 7, 2000 (IE) ..... 2000/0110

(51) Int. Cl.
*B65D 47/04* (2006.01)
*A47F 5/00* (2006.01)
*A46B 11/00* (2006.01)

(52) U.S. Cl. ..... 215/228; 215/305; 215/277; 220/212; 220/259.4; 401/118; 401/126; 248/309.1; 248/311.3

(58) Field of Classification Search ..... 215/228, 215/204, 277, 305; 220/259.4, 212; 401/118, 401/126; 248/309.1, 311.2, 311.3
See application file for complete search history.

(56) References Cited

U.S. PATENT DOCUMENTS 2,248,011 A * 7/1941 Neuschaefer ..... 401/6

(Continued)

FOREIGN PATENT DOCUMENTS

AU 70684/87 9/1988 ..... 47/42

(Continued)

*Primary Examiner*—Anthony D Stashick
*Assistant Examiner*—James N Smalley
(74) *Attorney, Agent, or Firm*—Steven C. Bauman

(57) ABSTRACT

A cap assembly for closing a container. The cap assembly has: (i) an undercap having a cap body with a top end (or wall) and with at least one endless side wall depending from the top end (or wall) to form a housing for receiving the neck of a container; (ii) an overcap having an overcap body with a top end and with at least one endless side wall depending from the top end to form a housing for receiving and engaging the (cap body of the) undercap; and (iii) an applicator having a stem with a first end for engagement with, or integrally formed with, the undercap within the housing, so that the stem projects from the housing, and a second free end for applying product. The exterior of the undercap body has a series of circumferentially arranged teeth for interengagement with a corresponding series of circumferentially arranged teeth within the housing of the overcap. The two series of teeth being interengageable at a number of relative positions, so that the relative orientation of the overcap to the undercap can be selected. As the undercap is adapted to be attached to the container, relative orientation of the overcap and the container is thus also selectable. In an alternative arrangement the two series of teeth form a safety or child proof cap arrangement. However, the application of a sufficient downward force upon the overcap causes the engagement of the two series of teeth allowing a user to rotate the overcap and undercap in unison. Biasing means may be provided to bias the overcap and undercap apart so that pressure must be applied against the biasing means to remove the cap assembly. Applicators are also provided as an assembly comprising an undercap and an applicator which can be assembled by screwing the undercap on a container into which the applicator has first been placed.

18 Claims, 19 Drawing Sheets

U.S. PATENT DOCUMENTS

| | | | | | |
|---|---|---|---|---|---|
| D169,266 | S | * | 4/1953 | Lehmann | D9/443 |
| 2,803,028 | A | * | 8/1957 | Flynn | 401/129 |
| 3,185,291 | A | * | 5/1965 | Lerner | 206/209 |
| 3,964,709 | A | * | 6/1976 | LaBelle et al. | 248/133 |
| 4,058,234 | A | | 11/1977 | Vrolyk et al. | 220/239 |
| 4,103,900 | A | | 8/1978 | Wittersheim | 277/2 |
| 4,125,201 | A | | 11/1978 | Birch | 215/330 |
| 4,196,819 | A | | 4/1980 | Fontanaud | 215/253 |
| 4,197,955 | A | | 4/1980 | Luenser | 215/252 |
| 4,271,974 | A | * | 6/1981 | Quinard | 215/331 |
| 4,273,248 | A | * | 6/1981 | Lehmann | 215/331 |
| 4,278,225 | A | * | 7/1981 | Phelps | 248/311.3 |
| 4,286,633 | A | | 9/1981 | Herr | 141/24 |
| 4,288,169 | A | | 9/1981 | McMenamin, IV | 401/175 |
| 4,326,639 | A | * | 4/1982 | Stahl et al. | 215/252 |
| 4,427,138 | A | | 1/1984 | Heinlein | 222/546 |
| 4,501,373 | A | | 2/1985 | Heinlein | 215/252 |
| 4,588,320 | A | | 5/1986 | Weinstein | 401/213 |
| 4,597,501 | A | * | 7/1986 | Gueret | 215/330 |
| 4,609,114 | A | | 9/1986 | Roy | 215/220 |
| 4,632,240 | A | * | 12/1986 | Goncalves | 206/15.2 |
| 4,752,015 | A | | 6/1988 | Schumacher | 215/228 |
| 4,863,302 | A | | 9/1989 | Herzfeld et al. | 401/289 |
| 4,955,745 | A | | 9/1990 | Vauquelin | 401/119 |
| 5,024,341 | A | | 6/1991 | Dekerle | 215/11.1 |
| 5,051,015 | A | | 9/1991 | Moeck | 401/202 |
| 5,110,231 | A | | 5/1992 | Monteith et al. | 401/190 |
| 5,190,389 | A | | 3/1993 | Vasas | 401/122 |
| 5,221,029 | A | | 6/1993 | Stull | 222/541 |
| D342,448 | S | * | 12/1993 | Ritcey | D9/443 |
| 5,316,399 | A | * | 5/1994 | Joulia | 401/127 |
| 5,340,228 | A | | 8/1994 | Wilcox et al. | 401/262 |
| D351,793 | S | * | 10/1994 | Stoller | D9/443 |
| 5,431,305 | A | * | 7/1995 | Kaminski | 222/109 |
| 5,603,428 | A | | 2/1997 | Breckwoldt | 220/755 |
| 5,660,288 | A | | 8/1997 | Nyman, Jr. | 215/44 |
| 5,690,241 | A | | 11/1997 | Montgomery | 215/28 |
| 5,715,967 | A | | 2/1998 | Pajak et al. | 220/359 |
| 5,746,531 | A | | 5/1998 | Izhak | 401/139 |
| 5,857,796 | A | | 1/1999 | Waldmann | 401/277 |
| 5,863,145 | A | * | 1/1999 | Dumler et al. | 401/129 |
| 5,934,457 | A | * | 8/1999 | Ueda et al. | 206/204 |
| 6,234,698 | B1 | | 5/2001 | DeLaforcade | 401/175 |
| 6,503,014 | B2 | * | 1/2003 | Louis et al. | 401/126 |
| 6,568,867 | B1 | * | 5/2003 | Okamoto | 401/129 |
| 6,634,821 | B2 | * | 10/2003 | Gueret | 401/126 |

FOREIGN PATENT DOCUMENTS

| | | | | | |
|---|---|---|---|---|---|
| DE | 27 04 461 | A1 | | 8/1978 | 41/34 |
| DE | 3007985 | A | * | 9/1981 | |
| DE | 31 08 517 | A1 | | 11/1982 | 41/62 |
| DE | 31 08 518 | A1 | | 11/1982 | 41/4 |
| DE | 31 18 833 | A1 | | 12/1982 | 55/2 |
| DE | 31 19 100 | A1 | | 12/1982 | 55/6 |
| DE | 31 19 248 | A1 | | 1/1983 | 55/12 |
| DE | 31 35 268 | A1 | | 3/1983 | 47/18 |
| DE | 31 38 873 | A1 | | 4/1983 | 51/18 |
| DE | 31 41 670 | A1 | | 5/1983 | 51/18 |
| DE | 31 44 924 | A1 | | 5/1983 | 49/12 |
| DE | 32 07 049 | A1 | | 9/1983 | 41/62 |
| DE | 32 33 803 | A1 | | 3/1984 | 51/20 |
| DE | 32 33 806 | A1 | | 3/1984 | 41/34 |
| DE | 33 17 373 | A1 | | 11/1984 | 5/16 |
| DE | 34 16 030 | A1 | | 10/1985 | 53/4 |
| DE | 34 17 001 | A1 | | 11/1985 | 47/20 |
| DE | 36 19 478 | A1 | | 12/1987 | 41/26 |
| DE | 37 15 957 | A1 | | 11/1988 | 11/26 |
| DE | 38 16 498 | A1 | | 11/1989 | |
| DE | 39 19 578 | A1 | | 11/1990 | |
| DE | 39 38 713 | A1 | | 5/1991 | 41/4 |
| DE | 40 07 325 | A1 | | 9/1991 | 41/4 |
| DE | 41 31 910 | A1 | | 4/1993 | 3/20 |
| DE | 42 02 044 | A1 | | 7/1993 | 51/30 |
| DE | 42 37 892 | A1 | | 5/1994 | |
| DE | 44 10 323 | A1 | | 9/1995 | 41/20 |
| DE | 197 28 447 | A1 | | 4/1998 | |
| EP | 0 019 236 | A3 | | 12/1980 | 47/42 |
| EP | 0 025 966 | B1 | | 6/1983 | 55/2 |
| EP | 0 202 406 | A2 | | 11/1986 | |
| EP | 0 215 202 | A1 | | 3/1987 | 41/4 |
| EP | 0 439 773 | A2 | | 8/1991 | 40/26 |
| EP | 0 290 720 | B1 | | 1/1993 | 41/34 |
| EP | 0 344 357 | B1 | | 2/1993 | 1/2 |
| EP | 0 570 760 | A1 | | 11/1993 | 55/8 |
| FR | 2 748 463 | | | 11/1997 | 3/20 |
| GB | 1 560 595 | | | 2/1980 | 47/42 |
| GB | 2 126 999 | A | | 4/1984 | 47/42 |
| GB | 2 142 743 | A | | 1/1985 | |
| GB | 2 148 859 | A | | 6/1985 | 41/4 |
| GB | 2 159 700 | A | | 12/1985 | 11/4 |
| GB | 2 233 549 | A | | 1/1991 | 17/4 |
| GB | 2 264 291 | A | | 8/1993 | 55/8 |

* cited by examiner

APPLICATOR, APPLICATOR CAP AND A CONTAINER HAVING AN APPLICATOR CAP

FIELD OF THE INVENTION

The invention relates to an applicator cap for applying a flowable product to a substrate and to containers for storing applicator dispensable products such as curable compositions for example cyanoacrylates (CA's), and indeed other products which dry or harden to a solid, for example correcting fluids and cosmetic compositions. The invention relates to an applicator cap assembly which is of simple construction yet reliable in use. The invention also relates to applicators and containers closed by applicator caps.

BACKGROUND TO THE INVENTION

Containers having associated applicator caps for dispensing materials held within the container are well known. Typically they comprise a cap/applicator assembly which is adapted to be threadibly received on a bottle. Usually, the applicator has a head which engages within a housing formed by the cap. However the applicator may be integrally formed with a cap, so that its stem projects from the cap. The applicator usually has a stem which projects from the head. At the free end of the stem are filaments or other suitable means typically in the form of an applicator element, for applying the contents of the container to a desired surface. Conventionally the cap/applicator assembly is fitted to a bottle or other container by screw threading the cap onto the neck of the bottle. In this arrangement the cap/applicator assembly is inserted into the bottle so that the stem projects downwardly into the container when the applicator cap is in place on the container. It is usual that the stem and associated filaments extend to the bottom of the container. In this arrangement it is usual that at least a portion of the stem projects into the contents of the container. The cap thus serves a dual function, closing the container and secondly holding the applicator. The cap is typically held by hand when removed from the container. Product on the applicator can be applied by manoeuvring the cap to contact the applicator (in particular the applicator element) to the desired surface. Product is thus applied to the surface.

There are problems associated with various containers having applicator caps due to their particular construction. The nature of the product contents of the container may also cause additional or exacerbate already existing problems with the applicator caps. For instance the particular problem associated with curable compositions such as CA's is that the container must provide an environment as free as possible from environmental contamination. The cap should also seal the container closed. Contamination of the product may cause premature curing so that the product becomes unusable. Fouling of the cap and/or the applicator is also problematic with many products which dry or harden to a solid. This is a re-occurring problem. For instance, curable products, tend to adhere to the underside of the cap making it difficult to replace the cap so as to properly seal the container, thus exacerbating the problem. It will be appreciated that this problem is not exclusive to curable products and occurs with other products, for example correcting fluids and cosmetic compositions. Furthermore, the applicator and in particular its stem and free end, should remain as free as possible from dried or solidified (and in particular cured) product to allow for ease of application of product during subsequent use.

Curable product which manages to find its way onto the underside of the cap tends to cure at a later stage. This can adhere the cap to the container making manual removal of the cap difficult or even impossible so that the entire container may be discarded, even though it still contains otherwise useable product. The product may also find its way into screw threads on the cap where it dries/hardens on the screw threads making removal and subsequent re-threading of the cap on the container difficult.

Furthermore as the applicator cap and container contact the CA, the materials used for manufacturing the cap, the applicator and the stem have to be CA compatible materials, i.e. they must not react with the CA's. Typical compatible materials used include: polypropylene (PP), high density polyethylene (HDPE) or low density polyethylene (LDPE). At least some grades of these materials are compatible with CA's. The selection of the material (usually a plastics material) is thus limited. It has been found that in some instances adding colour to a natural plastic material contaminates CA products contacting the coloured plastic and may initiate cure of the product thereby compromising storage stability. There has thus been a tendency to avoid colouring all components which contact the CA. Also some CA compatible plastics do not take well to colouring. In order to reduce the possibility of contamination of the CA the plastics material is usually colourless. It would be useful if at least part of the applicator cap could be constructed of a plastic which takes colour well. The choice of material is greater if CA compatibility does not have to be considered.

In filling processes for containers closed by applicator caps such as those described above, in order to obtain a reliable seal between the cap and the container a quite substantial torque may be used (particularly where the product is air sensitive) to tighten the screw-threaded cap onto the container. The torque used is sufficiently high to cause difficulties to some users relying on manual pressure applied to the cap to unscrew it from the container for use. This is undesirable as the end user may forsake using the product due to difficulty in removing the cap.

This problem is common for filling processes where an insert is placed in the container. It is known in containers having an applicator cap to provide an insert in the neck of the container. The insert has an external profile which matches the internal profile of the neck of the container. A central aperture is located in the insert which allows the applicator access to the container. It is usual also to provide a wiper surface in the form of a circular lip or rim on the inside of the insert extending about the central aperture which wipes along the applicator stem as the applicator is removed from the container, wiping excess product from the stem before it is removed from the container. The insert may also act as an anti-spill device which helps to retain product in the (uncapped) container even if the container is tipped over.

Filling processes include one known process where the insert is engaged within the housing of the applicator cap and the cap/insert assembly is then applied to the (filled) container. In this arrangement the action of screw-threading the cap onto the container is also used to engage the insert in the neck of the container. Retentive engagement of the insert in the neck of the container is achieved by tightening the cap securely on the container. This filling process suffers the problem of subsequent difficulty of removal of the cap due to the relatively high torque used to tighten the cap which is necessitated by the desire to correctly position the insert.

In cases where the user manages to disengage a cap from the container despite the presence of cured product between the cap and the container, which adheres the applicator and/or cap to the container, the applicator may be sufficiently well adhered to the container so as to become disengaged from the cap and remain seated on the neck of the container. This situation is clearly undesirable as in addition to destruction of the applicator/cap assembly the product within the container remains inaccessible to the user.

In the manufacture of conventional brush applicator caps, the process typically involves two steps, the first step involving the individual manufacture of the applicator and the cap, and the second the attachment of the applicator to the cap. The manufacture of the brush applicator involves the additional steps of extruding filaments, and then cutting, stapling and assembling them into the stem of the applicator.

Typically the second step is securing the applicator to the cap. The applicator for conventional brush applicators are formed by push fitting or snap-fitting the applicator, in the housing of the cap. The applicator is thus secured in the cap The filaments located on the end of the applicator stem are usually fragile and are easily damaged for example in production processes or in the fitting process described above. An applicator with damaged filaments is usually discarded. Assembly of the applicator cap is carried out before the applicator cap is applied to a filled container.

Finally the applicator cap is presented to a filled container and threadibly engaged on the neck of the container to close the container. As stated above if an insert is to be placed in the neck of the container the insert may be engaged in the housing of the cap as described above, or alternatively inserted into the neck of the container before the applicator cap is applied.

It is desirable for aesthetic and other reasons, such as ease of manual gripping to align a profile for example grips of an applicator cap to the profile of a container to which the applicator cap is applied. Normal filling processes allow fitting of an applicator cap at relatively disperse positions on the container, as the final position of the applicator cap is determined by applying the cap until a certain torsional force is achieved, rather than determined by its relative position to the container on which it is placed.

Furthermore, many products held within containers and particularly those applied with applicator caps are harmful if misused, for example contacted with certain parts of the body such as the eyes, or ingested etc. The dangers of such products are most real for those who do not appreciate the harm that they may cause. Accordingly it is desirable to provide a safety applicator cap, i.e. a cap which is difficult to open without using a predetermined procedure to open the cap. Such safety devices are often referred to as "child-proof" or "child-safety" caps, as it is the very young who often are most at risk if they inadvertently gain access to the contents of the container. Such safety caps are used on many types of containers, for example those which hold cleaning fluids or correcting fluids, pharmaceutical containers etc.

In view of the foregoing there is a need to provide an alternative procedure for filling and closing a container with an applicator cap, particularly during a process to prepare a filled container of dispensable material. There is also a need to make the applicator itself simple and more robust, in an effort to improve throughput during the manufacturing process.

There is also a need for an applicator and applicator cap that can be used with CA-type materials, yet can be manufactured from different materials; for example a cap which can be manufactured (independently from the applicator) from materials which are not necessarily compatible with CA's. To that end, it would be desirable that coloured plastics be used in the construction of the applicator cap. Furthermore it would be desirable to simplify the process for filling a container with product and capping it subsequently with an applicator cap. It would also be desirable to provide applicators which are useful for particular purposes. In particular it is desirable to provide an applicator which will retain sufficient product on its free end for the application type in hand. It is desirable also to provide a mechanism for matching a cap profile to a profile of the container to which it is applied. Furthermore it is also desirable to provide a applicator cap which acts as a safety applicator cap.

SUMMARY OF THE INVENTION

The present invention provides an applicator cap for a container having a container body with a neck on the container body. The applicator cap includes:

(i) an applicator comprising an applicator head with an applicator stem projecting therefrom, the stem having a free end for applying a product, (ii) a cap having a cap body with a top end (or wall) and with at least one endless side wall depending from the top end (or wall) to form a housing for receiving the neck of the container and the applicator head; and the cap and the applicator being attachable to each other by a plug and socket arrangement between the applicator head and the housing, the plug being engageable within the socket, characterised in that:

the plug and socket are secured against relative rotation by a co-operating engaging mechanism on the plug and the socket comprising a series of circumferentially arranged projections which are slidingly engageable within corresponding grooves on insertion of the applicator head in the housing.

In this arrangement the projections and grooves form interengaging formations which, (especially if each of the projections and each of the grooves are respectively spaced equidistantly apart) allow interengagement of the projections and the grooves at a number of different positions each where the projections and grooves are (axially) aligned. The interengaging formations can thus be considered as "multi-start" allowing interengagement in two or more different relative positions. Where there are n projections and n corresponding grooves (each equidistant apart), there are thus n positions where the projections and groove interengage or "start". Typically n is an integer in the range from 3-16 suitably in the range from 4 to 12. Desirably n is an even integer for example 4, 6, 8, 10 or 12. The integer n can thus be considered also as the number of starts.

Suitably the applicator further comprises a flange surface about the stem which closes an opening of the container when the cap is in place on the container. The opening of the container may be in a neck of the container or alternatively in an insert which is positioned at least partly within the neck of the container. In one arrangement the flange surface is located at a position on the stem directly beneath the applicator head. In one arrangement the flange forms an integral part of the applicator head, for example the lower end of the applicator head. The applicator head may form the plug while the socket may be formed in the housing.

Suitably the projections are formed as a series of circumferentially arranged teeth which are suitably elongate. The teeth have a longitudinal length which is greater than a transverse width. Suitably the teeth are between about 0.3 cm and about 2.0 cm in length for example between about 0.4 cm and 1.0 cm in length in particular about 0.5 cm in length. Suitably the width (measured where the rib has the largest width) is about 0.1 cm to about 1.0 cm in width more usually about 0.1 cm to about 0.5 cm and often about 0.3 cm. Suitably each tooth has a height of about 0.05 cm to about 0.6 cm, more typically about 0.08 cm to about 0.4 cm and often about 0.08 to about 0.2 cm and often about 0.1 cm. Suitably each tooth narrows or tapers inwardly from its base upwards and desirably opposing sides of the tooth meet to form a pointed or angular top for the tooth. The teeth typically are arranged so that a first end of the tooth faces substantially orthogonally to a longitudinal axis of the stem. Each tooth is typically twisted, skewed or angled through an angle of between about 9° and about 24°, more usually between about 12° and about 21° typically between about 15° to about 18°, along its length between its first and second ends. In other words the teeth are skewed by such an angle. When viewed end on, both ends of the teeth can be seen, due to the angular displacement of the tooth along its length. In particular if the teeth are taken to be arranged on, and projecting proud of, a cylindrical surface (due to their circumferential arrangement) the angle of displacement of the teeth about their longitudinal axes of their arrangement can be measured as angular displacement about the cylindrical surface. A line about the circumference of the cylindrical surface may also be termed the "root circle", a term borrowed from gearing mechanics. In the arrangement where the teeth are on the cap then they may be circumferentially arranged within the housing about a (central) longitudinal axis of the cap. In the arrangement where the teeth are on the applicator head they may be circumferentially arranged about a (central) longitudinal axis of the applicator. The teeth contort or entwine about the plug or within the housing. In this arrangement the teeth run along a series of paths following the general shape of deep concentric helices so that over their relatively short length they only partially travel about the plug or the socket. The grooves are reciprocally shaped to receive the teeth and may be circumferentially arranged also. The grooves may be formed by adjacent ones of circumferentially arranged teeth.

In one simple construction the applicator head forms the plug and the socket is formed in the housing. Desirably the projections are a series of circumferentially arranged teeth. Suitably each tooth is triangular in cross-section, and the grooves into which they fit have a corresponding cross-section.

From an end view the teeth are arranged to take the shape of a star. In one desirable construction the teeth are on the plug and the grooves are formed in the socket. In a simple construction the plug has a star-shaped (or multipointed) geometry (from an end view thereof). The plug thus resembles a cog or gear wheel which has been subjected to a torsional (shear) force which has resulted in the teeth of the cog or gear wheels having been twisted at their respective ends in opposing directions. In other words the teeth are formed as teeth of a skewed gear wheel. The teeth can be considered as having a multi-start, reverse helical, skewed spline profile. The term "reverse" is used in the sense of being the reverse direction to the direction of screw threads for holding the cap on the container.

In a preferred arrangement the teeth are spaced apart one from the next by equal amounts. Suitably an even number of teeth are provided though an odd number will also function well. It has been found that having 6, 8, 10 or 12 teeth is especially useful. In one particularly useful construction 10 teeth are provided.

In one particularly useful arrangement the projections are formed in a saw-tooth arrangement. The saw-tooth arrangement is a patterned arrangement with each tooth having a triangular cross section with adjacent sides of successive teeth meeting to define a v-shaped channel or groove between the teeth. Suitably this saw-tooth arrangement extends about the entire circumferential arrangement of the teeth. As in all cases the grooves are reciprocally formed to receive the teeth and thus can be considered also to be in a saw tooth arrangement. As stated above, for all arrangements of the teeth, the grooves may be reciprocally arranged.

In one embodiment, the applicator has an applicator element for applying product, at its free end. The applicator element may be integrally formed with the stem. The shape of the applicator element may be chosen for a specific end use. Suitably the applicator element is integrally formed with the stem.

The applicator cap of the invention may be used for dispensing cyanoacrylate (CA) type materials.

The cap is suitably manufactured from a plastics material such as LDPE, HDPE, or PP. Non CA compatible materials and/or colouring may be used in its manufacture.

The applicator stem is preferably manufactured from a CA compatible material, suitably a CA compatible grade of LDPE, HDPE or PP.

The invention provides an applicator cap for a container having a container body with a neck on the container body, the applicator cap comprising:

(i) an applicator comprising an applicator head with an applicator stem projecting therefrom, the stem having a free end for applying product;

(ii) a cap having a cap body with a top end and with at least one endless side wall depending from the top end to form a housing for receiving the neck of the container and the applicator head; and the cap and the applicator being attachable to each other by a plug and socket arrangement between the applicator head and the housing, the plug being engageable within the socket, characterised in that:

the plug and socket are secured against relative rotation by a co-operating engaging mechanism comprising a series of circumferentially arranged teeth on the plug and a series of circumferentially arranged teeth within the socket, one set of teeth being radially outwardly projecting, the other being radially inwardly projecting, the two sets of teeth intermeshing on insertion of the plug in the socket. Suitably both sets of teeth are skewed.

The invention also relates to a method of closing a container with an applicator cap. The method includes the steps of:

(i) optionally placing a desired amount of product within the container;

(ii) seating an applicator comprising an applicator head with an applicator stem projecting therefrom, the stem having a free end for applying product, on a neck of the container with the stem projecting into the container; and (iii) placing a cap having a cap body with a top end (or wall) and having at least one endless side wall depending therefrom to form a housing, over the applicator head and engaging the cap on the container, thereby simultaneously engaging the applicator within the cap.

Suitably in the method of the invention the applicator and cap are an applicator and cap of the present invention as described above.

The invention also relates to the container closed by the method of the present invention and in particular to containers for CA, closed by a method of the present invention.

The invention also relates to a container comprising a container body and an applicator cap according to the invention. The containers of the present invention may have a container body which is manufactured from a CA compatible material for example a suitable grade of LDPE, HDPE, or PP.

The invention also relates to an applicator comprising a stem with a first end for attachment to, or integrally formed with a cap, the stem having a free end comprising a flexible applicator element integrally formed with the stem, characterised in that, the applicator element has a straight-edged tip, the stem and applicator element being formed of CA compatible plastics. The applicator element may optionally comprise a series of longitudinal ribs. The ribs allow for retention of extra product on the tip of the applicator. The first end of the stem referred to in this and other applicator embodiments may be formed with (for example integrally formed with) an applicator head so that the stem projects from the applicator head. In such an arrangement it is desirable that the applicator head takes the form described in the embodiments referred to above.

The applicator element can be formed as for the applicators described below. The invention also relates to an applicator comprising a stem with a first end for attachment to, or integrally formed with a cap, the stem having a free end comprising a flexible applicator element integrally formed with the stem, characterised in that, the applicator element has a straight-edged tip, the straight edge of the tip being formed at an angle to the stem. Suitably the (acute) angle of the straight edge of the tip to (the longitudinal axis of) the stem is about 10° to about 60°, suitably about 15° to about 45° such as about 30°. This allows the applicator to be held at an angle. For manual applicators this may allow the adoption of a more natural position of the hand to hold the applicator cap.

The invention further relates to an applicator comprising a stem with a first end for attachment to, or integrally formed with a cap, the stem having a free end comprising a flexible applicator element integrally formed with the stem, characterised in that, the applicator element comprises integrally moulded filaments. Suitably the filaments are arranged sided by side in a row, and optionally may each be flat in cross section. Alternatively the filaments may be of rounded cross section, for example of circular cross section. The filaments may also be arranged at various relative positions on the stem for example arranged to form a brush-like arrangement. The filaments may thus act like a brush but be integrally formed with the applicator so that the applicator could be moulded as a single piece.

In a further embodiment the invention relates to an applicator comprising a stem with a first end for attachment to, or integrally formed with a cap, the stem having a free end comprising an applicator element integrally formed with the stem, characterised in that, the applicator element has a pointed tip. Suitably the applicator element is flexible. This arrangement allows for precision in application of product with the applicator.

In a yet further embodiment the invention relates to an applicator comprising a stem with a first end for attachment to, or integrally formed with a cap, the stem having a free end comprising a flexible applicator element integrally formed with the stem, characterised in that, the applicator element has at least one recess formed in it. Optionally the recess opens onto the tip of the applicator. For example the recess(es) may be of triangular shape, optionally with one apex, or the base of a triangle opening to the tip of the applicator. The recess(es) allow for the retention of extra product on the applicator tip.

The invention also relates to an applicator comprising a stem with a first end for attachment to, or integrally formed with a cap, the stem having a free end comprising a flexible applicator element integrally formed with the stem, characterised in that, the applicator element is concave in shape on at least one face. The applicator element may be concave on both of two opposing faces. This arrangement also allows for better retention of product on the applicator.

Also provided by the invention is an applicator comprising a stem with a first end for attachment to, or integrally formed with a cap, the stem having a free end comprising a flexible applicator element integrally formed with the stem, characterised in that, opposing sides of the applicator element are concave in shape. This applicator element allows for ease of application of product.

In a yet further arrangement the invention relates to an applicator comprising a stem with a first end for attachment to, or integrally formed with a cap, the stem having a free end comprising an applicator element integrally formed with the stem, characterised in that the applicator element is conical in shape. In this embodiment the apex of the conical applicator element forms the tip of the applicator. Suitably the applicator is flexible. This arrangement also allows for precise application of small amounts of product.

The invention also provides an applicator comprising a stem with a first end for attachment to, or integrally formed with a cap, the stem having a free end comprising an applicator element integrally formed with the stem, characterised in that the applicator element is spherical or part-spherical in shape. Suitably the applicator is flexible. This arrangement allows for dropwise or dot application of product.

In another construction the invention relates to an applicator comprising a stem with a first end for attachment to, or integrally formed with a cap, the stem having a free end comprising a flexible applicator element integrally formed with the stem, characterised in that the applicator element has at least one conduit running from the tip of the applicator element toward the stem, the conduit being dimensioned for uptake of liquid product by capillary action. This arrangement allows the uptake of product into specific regions of the applicator, and equally precise application of product from the uptake regions to the substrate.

The invention also relates to an applicator comprising a stem with a first end for attachment to, or integrally formed with a cap, the stem having a free end comprising a flexible applicator element integrally formed with the stem, characterised in that the applicator element is formed by a series of rods or ribs running lengthways along the applicator element to its tip, the rods or ribs being joined each to the next along their respective lengths by material of lesser thickness (and suitably planar) so that the rods project proud of opposing faces of the applicator element. Surfaces are thus provided on both side of the applicator element which allows retention of extra product.

In yet another embodiment the invention relates to an applicator comprising a stem with a first end for attachment to, or integrally formed with a cap, the stem having a free end comprising a flexible applicator element integrally formed with the stem, characterised in that the applicator element has a series of rods or ribs running transversely across the applicator element. This arrangement also allows for good retention of product.

The invention further provides an applicator comprising a stem with a first end for attachment to, or integrally formed with a cap, the stem having a free end comprising a flexible applicator element integrally formed with the stem, characterised in that the applicator element comprises a series of longitudinal channels formed in the surface of the applicator element. This arrangement also allows for better retention of product on the applicator.

The invention also provides an applicator comprising a stem with a first end for attachment to, or integrally formed with a cap, the stem having a free end comprising a flexible applicator element integrally formed with the stem, characterised in that the applicator element comprises a series of channels formed in a surface of the applicator element. The invention also relates to an applicator comprising a stem with a first end for attachment to, or integrally formed with a cap, the stem having a free end comprising a flexible applicator element integrally formed with the stem, characterised in that the applicator element comprising a series of channels formed therein and arranged in a grid, the channels optionally intersecting. The channels may be formed as a grid, optionally with transverse and longitudinal channels substantially at right angles to each is other or arranged to form a diamond-shaped grid. Again these arrangements allow for better retention of product.

The invention further relates to an applicator comprising a stem with a first end for attachment to, or integrally formed with a cap, the stem having a free end comprising a flexible applicator element integrally formed with the stem, characterised in that the applicator element comprises a series of transverse channels formed therein. The channels are provided to hold extra product.

The invention also relates to an applicator comprising a stem with a first end for attachment to, or integrally formed with a cap, the stem having a free end comprising a flexible applicator element integrally formed with the stem, characterised in that the applicator element comprising a series of ribs formed as a grid, optionally with the ribs substantially at right angles to each other or optionally arranged to form a diamond-shaped grid. Optionally the ribs intersect.

Also provided is an applicator comprising a stem with a first end for attachment to, or integrally formed with a cap, the stem having a free end comprising a flexible applicator element integrally formed with the stem, characterised in that the applicator element comprises a series of depressions formed in its surface.

The invention in a further aspect relates to an applicator comprising a stem with a first end for attachment to, or integrally formed with a cap, the stem having a free end comprising a flexible applicator element integrally formed with the stem, characterised in that the applicator element comprises a series of depressions formed in its surface. For example the applicator element may be pitted for example a series of depressions may be formed the surface, such as an in orange-peel effect. The channels will be shallow and usually are in the range of about 0.01 mm to about 0.2 mm typically about 0.05 mm to about 0.15 mm and often about 0.1 mm. Where ribs are provided they will typically stand proud of the surface of the applicator element to a height of about 0.01 mm to about 0.2 mm typically about 0.05 mm to about 0.15 mm and often about 0.1 mm.

When depressions are formed in the applicator element, these are typically shallow with a depth from the surface or about 0.1 mm or less, such as about 0.01 mm to about 0.08 mm. The depressions or channels may be moulded, scored or otherwise formed in the applicator element.

For use with CA's it is desirable that the applicator element and the stem are constructed of CA compatible material. Unless otherwise stated the applicator element may be flat-shaped or circular in cross section—so too may the stem. At least one reinforcing rib, for example two opposing reinforcing ribs may be provided along at least part of the stem to provide a more rigid stem.

In another aspect the invention provides a cap assembly for closing a container, the cap assembly comprising:

(i) an undercap having a cap body with a top end (or wall) and with at least one endless side wall depending from the top end (or wall) to form a housing for receiving the neck of a container; and (ii) an overcap having an overcap body with a top end and with at least one endless side wall depending from the top end to form a housing for receiving and engaging the (cap body of the) undercap;

the exterior of the undercap body having a series of circumferentially arranged teeth for interengagement with a corresponding series of circumferentially arranged teeth within the housing of the overcap, one series of teeth projecting radically outwardly the other series of teeth projecting radially inwardly, the two series of teeth being interengageable at a number of relative positions, so that the relative orientation of the overcap to the undercap can be selected. As the undercap is adapted to be attached to the container, relative orientation of the overcap and the container is thus also selectable. Suitably the teeth on the exterior body of undercap project radially outwardly while those within the housing project radially inwardly.

Suitably the undercap is an applicator cap further comprising an applicator having a stem with a first end for engagement with, or integrally formed with, the undercap within the housing, so that the stem projects from the housing, and a second free end for applying product.

As for the embodiments of applicator cap described above, the teeth (suitably in both series) are spaced, one from the next, by an equal distance so that if there are n teeth there are n positions at which the teeth interengage. The value of n may be selected from those integers in the range of from about 20 to about 60 so that for evenly spaced apart teeth each interengagement position is between about 18° and about 6° apart. If there is an exact desired relative orientation of the overcap and the container and the teeth are 18° apart the furthest an interengageable position will be away from the desired position is 9° For the applications of the present invention it has been found useful to provide from about 30 to about 40 teeth in each series for example about 36 teeth. With 36 teeth the furthest an interengageable position will be away from the desired position is 5°. This level of accuracy is acceptable for the applicator cap of the present invention. It is clear that using the cap assembly of the present invention, the relative orientation of the overcap and the container can be selected to a desired degree of accuracy.

Suitably the undercap and the overcap are snap-fit engageable with each other. This allows for ease of joining of the two parts. Suitably the snap-fit construction is a non-return snap-fit which, locks the parts together.

One construction of overcap where the cap assembly of the invention is useful, is where the overcap has grips projecting from the exterior of overcap body and it is desired to place the grips in a selected position relative to the container body. For example the grips may be two opposing wings, on either side of the overcap body. The grips are substantially planar, being substantially less in thickness than the diameter of the overcap body at any given point. While the overcap tapers inwardly from its lower end to its top end, the outer edge of the grips may taper outwardly from their lower ends to their top ends. It may be desirable to position the two opposing grips so that they are substantially aligned with (in the fully applied position of the cap assembly) a front side of container body. This arrangement may be achieved with the cap assembly of the present invention.

The invention also relates to a method of capping a container with a cap assembly for closing the container, the cap assembly comprising:

(i) an undercap having a cap body with a top end (or wall) and with at least one endless side wall depending from the top end (or wall) to form a housing for receiving the neck of a container; and (ii) an overcap having an overcap body with a top end (or wall) and with at least one endless side wall depending from the top end (or wall) to form a housing for receiving and engaging the undercap;

the exterior of the undercap body having a series of circumferentially arranged radially outwardly projecting teeth for interengagement with a corresponding series of circumferentially arranged radially inwardly projecting teeth within the housing of the overcap, the two series of teeth being interengageable at a number of relative positions, so that the relative orientation of the overcap to the undercap can be selected, the method comprising the steps of optionally placing product in the container;

closing the container with the undercap; and engaging the overcap over the undercap at a selected relative orientation to the container body. Suitably the undercap is an applicator cap further comprising a stem with a first end for attachment to, or integrally formed with, the undercap within the housing, so that the stem projects from the housing, and a second free end for applying product;

The invention also relates to a container closed by this method.

In a yet further embodiment the present invention provides a cap assembly for closing a container, the cap assembly comprising:

(i) an undercap having a cap body with a top end (or wall) and with at least one endless side wall depending from the top end (or wall) to form a housing for receiving a neck of a container and screw-threads formed in the housing for screw thread engagement with screw-threads on a neck of the container;

(ii) an overcap having an overcap body with a top end (or wall) and with at least one endless side wall depending from the top end (or wall) to form a housing for receiving and retaining the undercap within the housing with a range of free axial relative movement of the overcap and the undercap between upper and lower limits;

the top end (or wall) of the undercap body having a series of circumferentially arranged axially upwardly projecting teeth for interengagement with a corresponding series of circumferentially arranged axially downwardly projecting teeth within the housing of the overcap, the two sets of teeth being arranged to interengage when the overcap is twisted in a direction for screwing the cap assembly onto the container, the two sets of teeth being arranged to ride across each other without interengaging, due to relative axial movement of the overcap and the undercap, when the overcap is twisted in a direction for unscrewing the cap assembly, Desirably the undercap is an applicator cap further comprising a stem with a first end for attachment to, or integrally formed with, the undercap within the housing, so that the stem projects from the housing, and a second, free end for applying product, Suitably the two sets of teeth interengage with each other when downward pressure is applied to the overcap simultaneously while the overcap is twisted in a direction for unscrewing the cap assembly. This provides a safety cap mechanism which is child-proof. Suitably there are between about 3 and about 40 teeth on the top wall of the undercap, though it is desirable to use between about 4 and about 20, for example up to about 14 and typically about 6. Typically at least one of the two sets of teeth and desirably the teeth on the undercap has an oblique face or ramp on one side of each tooth. This oblique face is arranged so that the teeth within the housing of the overcap will ride across the oblique surface. This movement is allowed as the undercap and overcap are not axially immovable with respect to each. However if sufficient downward force is applied to the overcap the teeth of the overcap will engage with the teeth of the undercap at the junction of the teeth and the undercap. Typically sides of the teeth opposing the oblique face or ramp are substantially orthogonal to the top wall of the undercap. The teeth with the oblique face may be in the form of a right angle triangle in cross section. The right angle may be found between the top wall of the undercap and the tooth so that one side of the triangle is substantially perpendicular to the undercap and is presented toward the direction of screwing on of the cap, while the (sloped) side of the triangle diagonally opposite the right angle is presented toward the direction of unscrewing of the cap. Conventionally the direction of screwing on of caps is the clockwise direction, while the direction of screwing off is the anticlockwise direction (viewed from above). The teeth are thus arranged with their oblique edges slanting upwards from the base of the teeth from left to right (i.e. in an anticlockwise direction and again when viewed from above). The degree of axial freedom may be provided by a rim and groove arrangement which may form part of a snap-fit mechanism between the overcap and the undercap. Suitably the snap-fit mechanism is a non-return snap-fit mechanism to lock the overcap to the undercap.

BRIEF DESCRIPTION OF THE DRAWINGS

The invention will be described below with reference to the following drawings in which.

It should be noted that the Figures are each drawn to a scale which aids illustration of the features in question. Components which are assembled together are not necessarily drawn to exactly the same scale in each of the various Figures.

DETAILED DESCRIPTION OF THE INVENTION

The invention will now be described with reference to the accompanying drawings.

Figure 1:
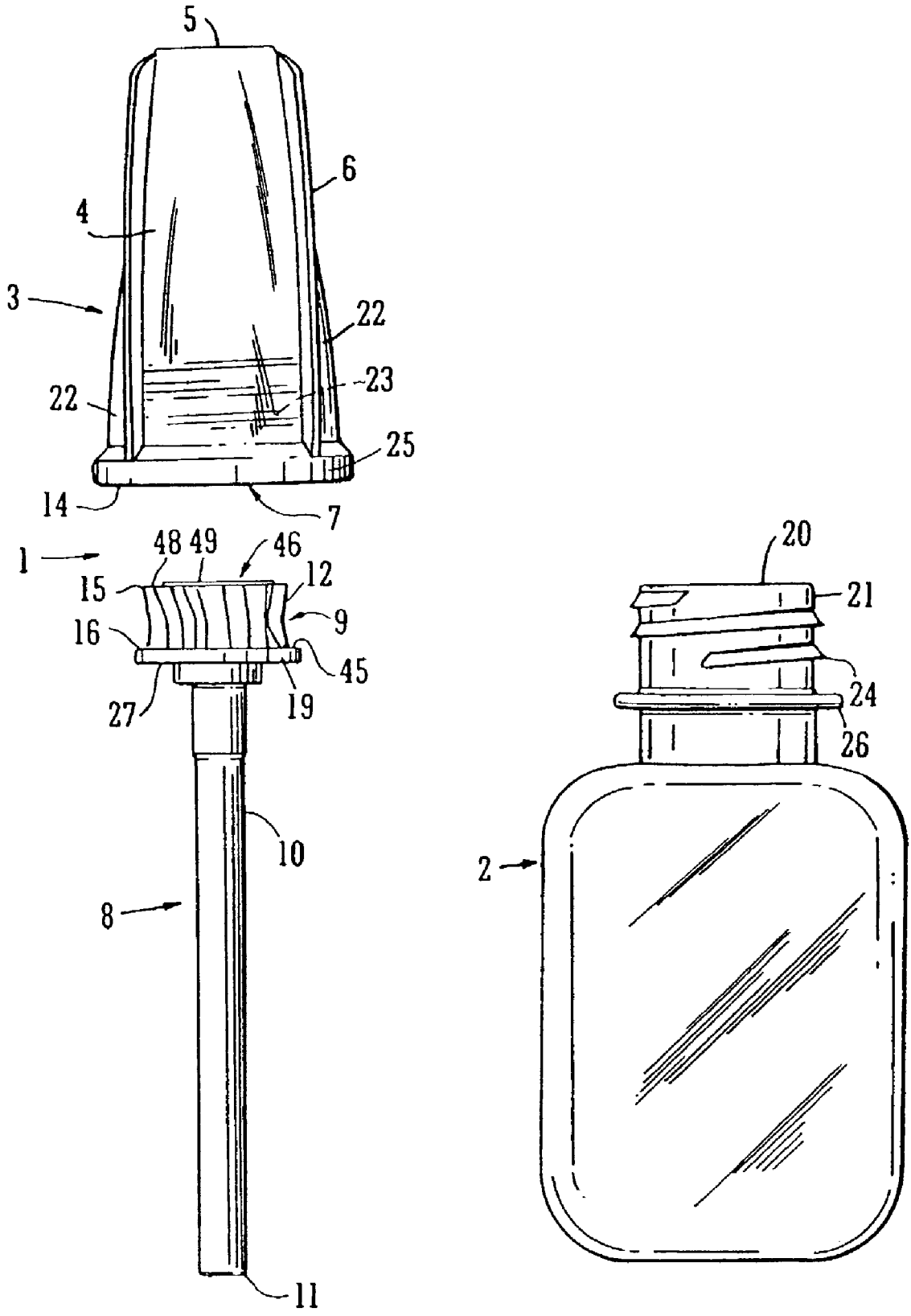
FIG. 1 is an elevational view of an applicator cap of the present invention for a container.

FIG. 1 shows an exploded view of an applicator cap 1 for use with a container 2.

The applicator cap comprises an assembled arrangement of a cap 3 and applicator 8. The cap 3 comprises a cap body 4 with a top end in the form of a top wall 5 with an endless side wall 6 depending therefrom. The top wall 5 and the side wall 6 form a housing 7 for receiving a neck 14 of the container 2. The side wall 6 is generally in the form of the skirt creating the housing with circular cross section.

The applicator 8 has an applicator head 9 with an applicator stem 10 projecting from it. The applicator has a free end 11 for applying product from the container 2 to the desired surface on the substrate. In the embodiment shown the free end 11 is not adapted for any particular mode of application. The head 9 acts as a plug while the cap 3 acts a socket receiving the head 9 within the housing 7.

Figure 2:
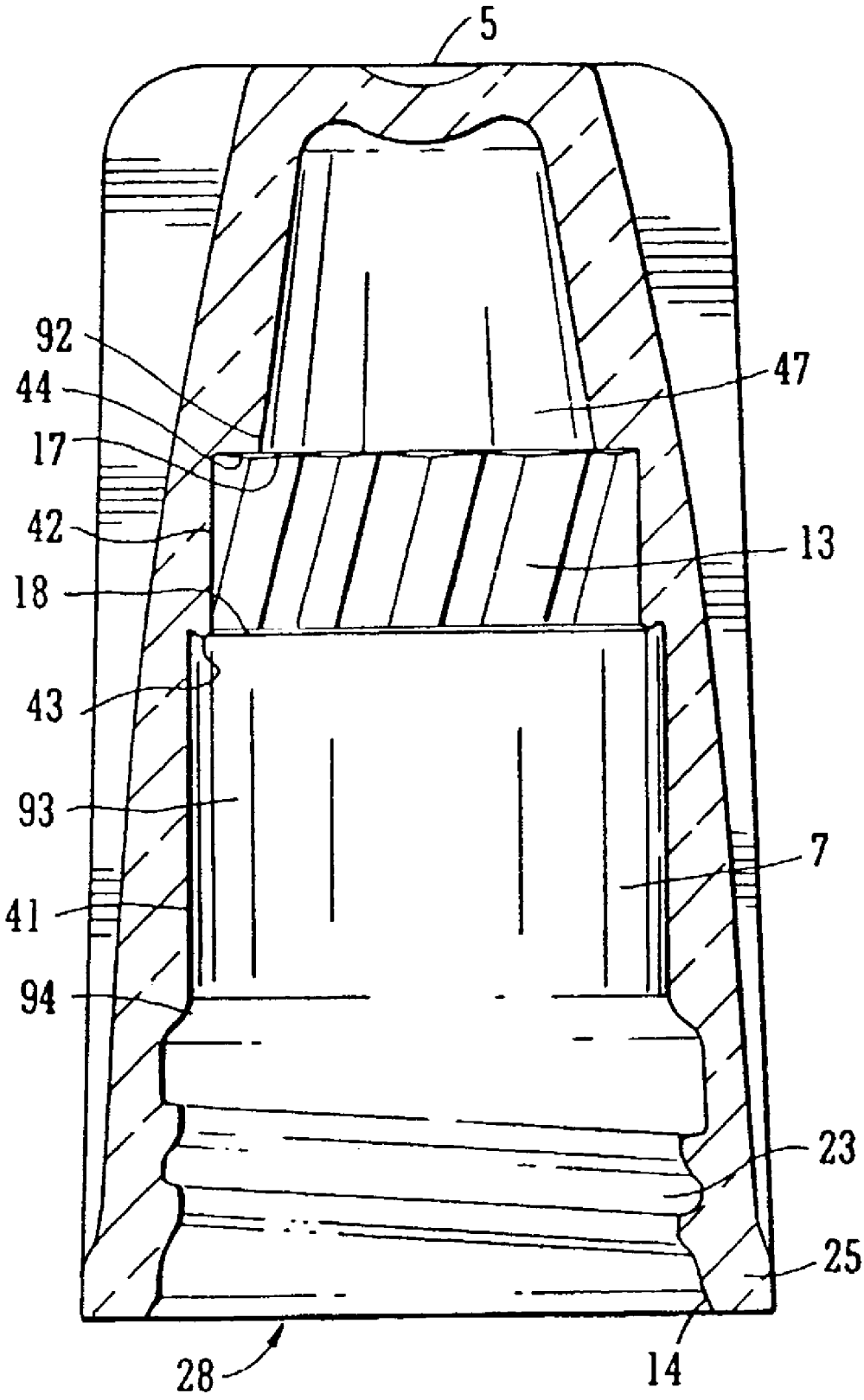
FIG. 2 is a sectional view thought one side of the cap of FIG. 1.

A cross-sectional view of the cap is shown in FIG. 2. The applicator and the cap 3 comprise co-operating interengaging means in the form of a series of circumferentially arranged projections or teeth 12 which are slidingly engageable in corresponding grooves 13 formed on the underside 14 of the cap 3 and within the housing 7.

Figure 4:
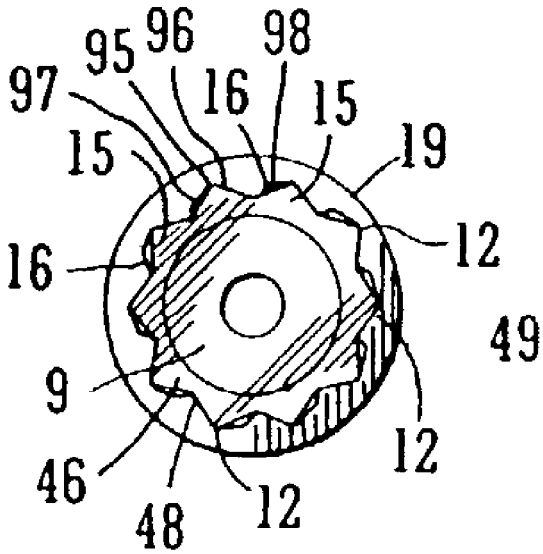
FIG. 4 is a top plan view of the applicator of FIG. 1.

The top end of wall 5 of the cap 3 is substantially planar. It could alternatively be rounded or pointed. The housing 7 tapers inwardly along the interior surface 41 of side wall 4, from the mouth 28 of the cap 3, to the top wall 5. The housing 7 is also stepped. Stepping occurs at a number of places along the interior surface 41 of the side wall 4 in particular where the housing 7 is decreased in diameter to form a socket 42 with a diameter less than that of the mouth 28. The grooves 13 are formed on the interior wall of the socket 42. The socket 42 is also defined by the interior surface of the side wall of the housing 7 which is of shorter diameter between a lower rim 43 and an upper rim 44. An upper surface 45 of a flange 19 on the applicator head 9 is arranged to abut and mate with the rim 43 an insertion of the applicator head 8 into the socket 42. The upper rim 44 defines a stop or abutment surface against which the outer edge of an upper (substantially planar) surface 46 of the head 9 abuts. Above the socket 42 is a cavity 47. At least that region 48 of the upper surface 46 of the head 9 which abuts the rim 44 is planar to provide contact over the abutment area. The area within the abutment area may be a raised surface (as best seen from FIGS. 1 and 4) such as cylindrical surface 49. The raised surface 49 on the top surface of the head 9 mates with a mouth 92 of the cavity 47 providing for more secure engagement of the application head 9 within the housing 7. For convenience the raised surface 49 is shown in FIGS. 1 and 4 only.

The teeth 12 are triangular in transverse cross section as are the corresponding grooves 13. It can be seen (in particular from FIG. 4) that the teeth 12 contort, twist or entwine about the applicator head 9 to give a star shape or cog or gear wheel appearance. The teeth 12 are each formed as part of a deep helix. In particular the teeth 12 run longitudinally along the applicator, the part of the helix each is formed from being deep, so that the teeth move further up the applicator head than about it.

Conventional screw threads usually comprise a single helix which engages with a reciprocal single helix. In the conventional arrangement there is only one mating position where the separate helical threads may inter-engage on relative rotation to start the screw-on process.

Furthermore in conventional screw thread arrangements there is only one direction of relative rotation, for example clockwise or anticlockwise which will result in the interengagement of the screw threads. In the arrangement of the present invention, the interengaging formations can interengage on relative rotation in each direction.

In the embodiment illustrated in the drawings, the teeth 12 are arranged in a saw-tooth arrangement. Each tooth is triangular in cross-section having an apex, crest or pointed surface 95. As stated above the teeth are arranged in a skewed gear arrangement. The teeth can be considered to be arranged about a root circle, a term from the mechanics of gearing, to describe the circle about which the (base of the) teeth can be considered to be arranged. Each tooth tapers outwardly in a generally triangular form, on its respective sides 96, 97 to its base which is arranged with the other teeth, as stated above, about a root circle. The particular saw tooth arrangement provides that opposing sides 96, 97 of adjacent teeth meet to form a generally v-shaped channel 98 between adjacent teeth.

One could also consider the grooves 13 as a corresponding intermeshing set of teeth, which are arranged to intermesh with the teeth 12. In this respect the socket 42 is provided also with a series of teeth 101 (one between and part-defining each groove). Each tooth 101 has an apex, crest or pointed surface 102 and with side walls 103, 104 defining the generally triangular shaped teeth. The teeth 101 are offset, angled, or skewed as described above. The teeth 101 are also arranged about a root circle though in this case the teeth 101, in contrast to teeth 12 face radially inwardly (from the root circle), and are arranged to intermesh with the teeth 12. The interengaging arrangement can thus be considered a series of radially outwardly projecting teeth and a reciprocal series of radially inwardly projecting teeth, one set on a plug, the other on a socket, the sets of teeth intermeshing when the plug is inserted in the socket.

The teeth 101 within the socket 42 are arranged about a root circle of larger diameter than the teeth 12 on the head 9. In contrast to the conventional meshing of gear teeth which often are arranged to mesh over part of each of the gears at any one time, the teeth 101 and teeth 12 intermesh about their entire circumferences, as one inserts into the other.

Figure 3:
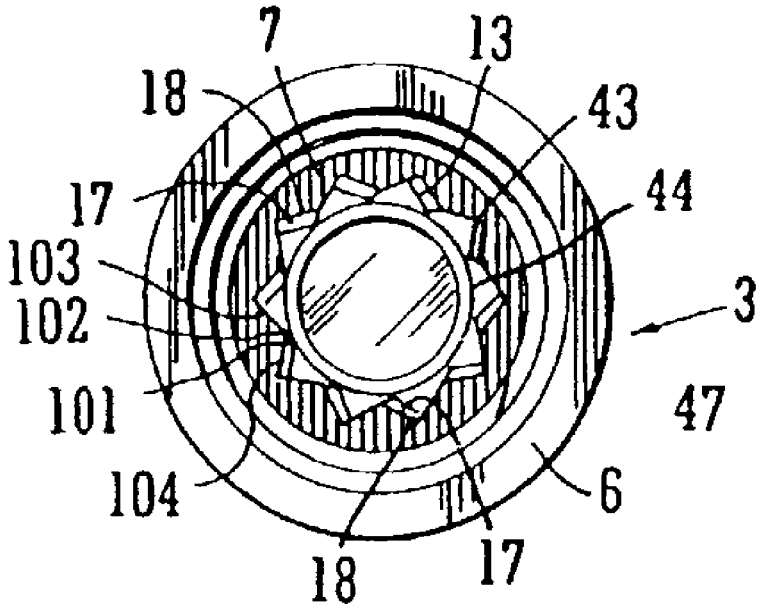
FIG. 3 is an underneath plan view of the cap of FIGS. 1 and 2.

In the applicator cap of the present invention the cap and applicator co-operate to allow sliding engagement of the applicator and cap. This is due to the orientation of the part helical teeth and grooves. The teeth 12 are arranged longitudinally generally running in the same direction as the longitudinal axis of the circular arrangement run generally along in the same direction as, yet curve about the axis. The teeth 12 do not run parallel to this axis, but are arranged at an angle to the axis. The grooves 13 are reciprocally formed to accommodate the teeth 12. An upper end 15 and a lower end 16 of each tooth 12 can then be seen in end view as shown in FIG. 4. In particular the teeth 12 move in an anticlockwise direction (from the perspective of the end view of FIG. 4) about the applicator or head 9 due to their angular displacement along their length. The grooves 13 are shaped reciprocally to receive the teeth 12. As can be seen from FIG. 3 the grooves 13 have upper and lower ends respectively labelled 17 and 18. The term "upper end" as used to refer to the grooves 13 assumes the orientation of the cap 3 in the position shown in FIGS. 1, 2, 5 and 6. In the orientation of cap 3 in the position shown in FIGS. 1, 2 and 5 the grooves 13 move in a clockwise direction from their lower ends 18 to their upper ends 17 due to their angular displacement along their length.

The applicator 8 also has a circumferential flange 19 which is located on the stem 10 between the applicator head 9 and the free end 11. The flange 19 in the embodiment shown is integrally moulded with the applicator head 9. The flange 19 is designed to engage over an upper rim 20 of the neck 21 so that the lower surface 27 of the flange 19 acts to close an opening in neck 21 of the container 2. The flange 19 also has an upper surface 44. The flange 19 provides a reliable seal with the neck 21 of the container 2 so that product in the container does not find its way beyond the flange 19 when the cap/applicator assembly 1 is placed on the container. This is best seen from the mated position of FIG. 5 where the lower surface 27 of the flange 19 mates with the upper rim 34 on the insert 30 providing a reliable seal. As a reliable seal is provided it is thus possible to utilise materials to manufacture the cap 3 which would otherwise not have been used due to their incompatibility with the product within the container 2. For CA products this means that materials which would normally be considered CA incompatible materials, for example plastics such as some grades of LDPE, HDPE or PP, can be used. Also CA compatible or CA incompatible plastics can be utilised in a non-natural state, for example the cap may be constructed of coloured plastics etc.

The exterior of the side wall 6 of the cap 3 has a series of grips 22 integrally moulded with the cap body 4 to allow for ease of manual gripping of the cap 3.

The cap and the container 2 are provided with co-operating inter-engaging formations in the form of co-operating screw threads. Screw threads 23 are formed on the underside of the cap 3 and within the housing 7. The neck 21 of the container 2 is also provided with screw threads 24 which (together with the screw threads 23 on the cap) allow for screw thread engagement of the cap 3 on the neck 21 of the container 2.

The side walls 6 of the cap 3 generally form a skirt depending from the top wall 5. The side wall 6 is formed into a rim 25 at the lower end. The rim 25 is arranged to engage a circumferential flange 26 on the container 2 when the cap 3 is screwed onto the container 2 as described above. The rim 25 may be used to serve a dual purpose. The rim 25 may be used to abut the flange 26, so that flange 26 acts as a stop to locate the cap 3 in a desired position on the container, for example at a position where sufficient torque has been applied to screw on the cap 3. The rim 25 may also be used to provide an extra degree of closure for the cap by co-operating with flange 26. Usually the rim 25 is provided to help prevent cross-thread movement of the cap on the screw threads on the neck of the container.

The filling of the container and its subsequent closure with applicator cap 1 will be discussed in detail with reference to FIG. 6 in particular.

Figure 5:
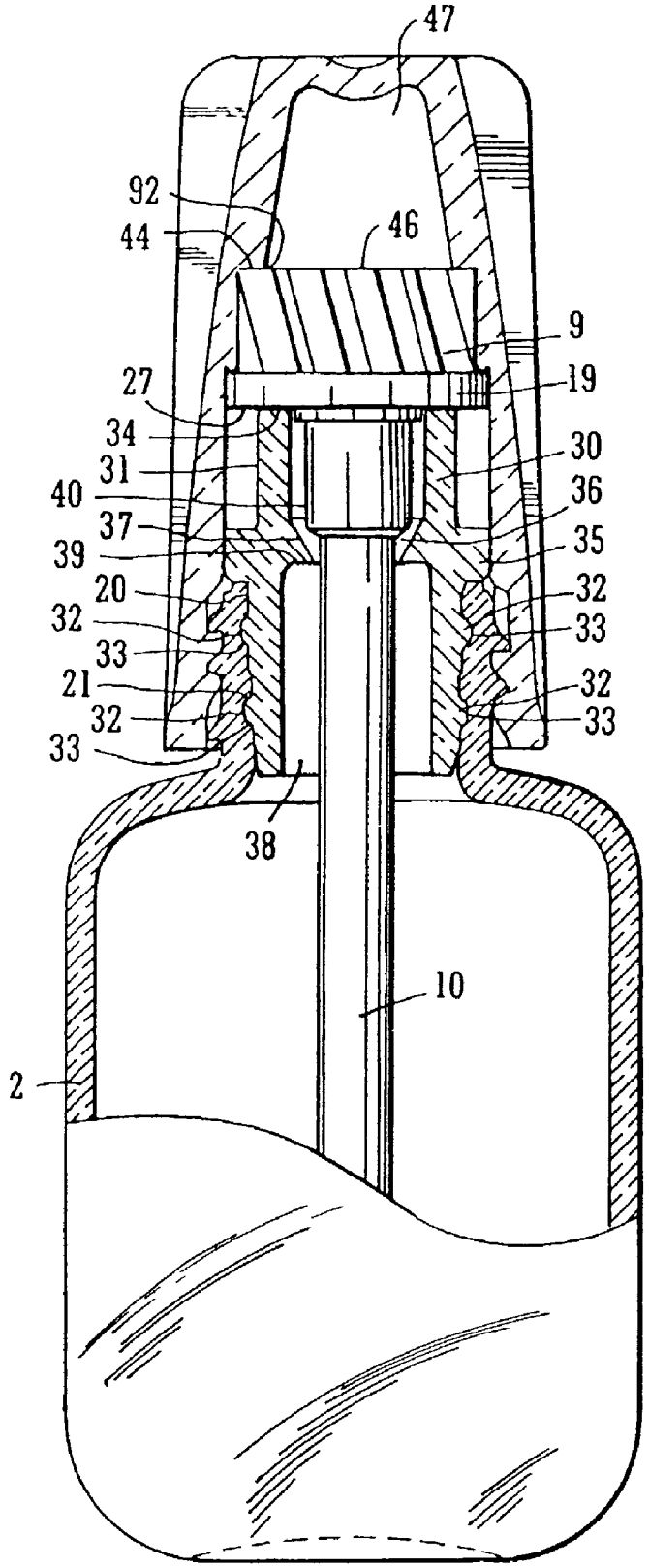
FIG. 5 is a side part-sectional view of the cap and applicator assembly fitted to the container of FIG. 1, the container further having an insert in the neck thereof.
Figure 6:
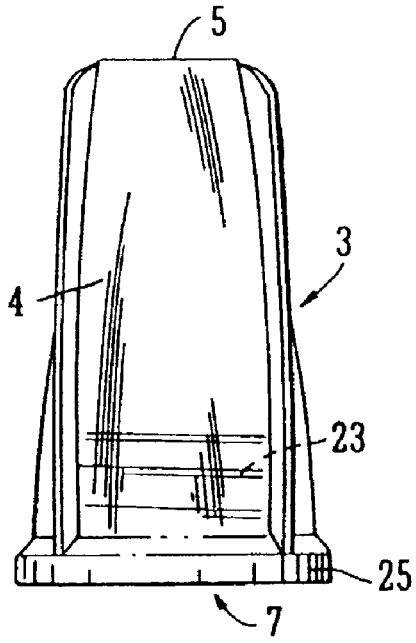
FIG. 6 is a side view (showing some internal detail) of a container with an insert in the neck of the container, and an applicator cap seated on the container in a mode of assembly according to the invention.
Figure 6:
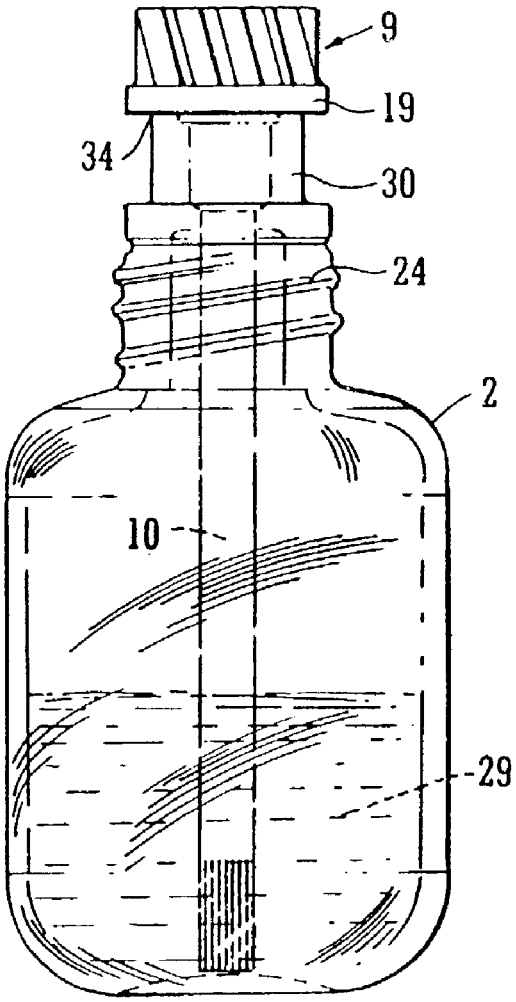

In FIG. 6 an amount of product 29 has been placed in the container 2. In the embodiment of FIGS. 5 and 6 there is inserted a conventional insert 30 in the neck 21 of the container 2. For convenience the flange 26 shown in FIG. 1 has been omitted from FIGS. 5 and 6. The insert 21 is (snap-)fitted into the neck of the container. It has two main functions. Firstly, the insert 21 acts as an anti-spill device in the event that the container 2 is knocked over. Secondly, it acts as a wipe to keep the applicator stem 10 free of product. In the embodiment of FIGS. 5 and 6 the insert 30 is of a generally cylindrical construction comprising an annular (endless) side wall 31 which snap-fits into the neck 21 by engagement of detents 32 on the exterior of the insert in corresponding recesses 33 on the interior surface of the neck 21.

The applicator 8, and in particular the flange 19, rests on an upper rim 34 of the insert 30. The insert 30 extends to a position proud of the rim 20 of the neck 21. A circumferential flange 35 on the exterior of the insert 30, rests on the neck 21. The opening for inserting the applicator 8 into the container is thus formed in the insert 30 by a conduit 38 through the insert. The anti-spill/wiper function of the insert is achieved by the provision of a dished aperture 36 in an internal rim 37 of the insert 30. The internal rim 37 is formed as a throat or restriction in the conduit 38 extending further across the (interior of the) neck of the container, and proud of the internal surface of the neck. The lower edge 39 of the dished aperture 36 is smaller in circumference than its upper edge 40 and the rim 37 is dimensioned so that its lower edge 39 extends close enough to the stem 10 to act as a wipe. It will be appreciated that the insert 30 will also act as an anti-spill device due to the restriction of the neck of the container by the internal rim 37 which is less likely to allow spillage of product than a container without the insert fitted.

To place product in, and subsequently close, a container with the applicator cap of the invention, the following steps are suitably undertaken, with reference in particular to FIG. 6:

1) If desired, an amount of product 29 is placed in the container.

2) The applicator 8 is inserted (stem first) into the container, the length of the applicator stem 10 being of a length which allows the flange 19 to rest (either directly on the rim 20 of the neck 24 of the container 2) or on an upper rim 34 on an insert 30 in the neck 21 as discussed above and as shown in FIG. 6;

3) The cap 3 is presented to the applicator head 9, the cap 3 is brought down to engage the neck of the container, the head 9 is received within the housing 7 of the cap.

The head 9 of the applicator is dimensioned to be received at least partly in the first area 93 of the housing 7 between the lower rim 43 of the socket 42 and the upper end 94 of the screw threads 23. In this position the start of the screw threads 23 on the cap 3 and the start of the screw threads 24 on the neck of the container can mate even though the applicator head may not yet be even partly engaged within the socket 42.

As the cap 3 is rotated to thread about the neck of the container 2 the screw threads 23 and 24 interengage bringing the cap 3 progressively downwards onto the neck of the container. The grooves 13 and the teeth 12 interengage (and thus interlock) at the position where they are aligned. Further screw threading of the cap 3 onto the container 2 causes the applicator head 9 to progressively insert within the socket 42. Once the grooves 13 and teeth 12 have become interengaged the applicator 8 moves with the cap 3. When the cap 3 is fully screwed down the applicator head 9 is fully engaged within the socket 42 as shown in the cross-sectional view of FIG. 5. The applicator 8 is thus engaged within the housing 7. The cap 3 and the applicator 8 are locked against relative rotation by the interengagement of the teeth 12 and the grooves 13. The teeth 12 and the grooves 13 interengage to securely position and retain the applicator 8 within the cap 3.

Due to the reciprocal shape of the teeth 12 and the grooves 13, at a given point of screw threading the cap 3 onto the container by inter-engaging screw threads 23 and screw threading 24, the grooves and teeth become aligned. In the embodiment illustrated there are ten teeth and ten corresponding grooves so that there are ten positions where the teeth and grooves are aligned and can interengage. When one of these ten positions is reached, pressure from the screwing on action causes the teeth 12 to slidingly engage in the grooves 13, and progressive relative rotational movement of the cap 3 and the container 2 bring the applicator 8 and cap 3 closer together. When the cap 3 is securely fitted to the container 2 the applicator 8 is firmly held within the cap 3. Later removal of the cap 3 also removes the applicator 8. The applicator and cap then form an applicator cap assembly which functions as a conventional applicator cap.

By provision of the intermeshing arrangement between the socket within the housing and the applicator head, screwing on of the cap is not hindered by the applicator resting on the neck of the container. Continuous threading of the cap is possible without interference from the applicator, and in particular without interference from the applicator head.

As discussed above the teeth 12 and grooves 13 generally are arranged to resist rotational force and thus prevent the cap and applicator becoming disengaged by torsional force used to remove the cap. As best illustrated in FIG. 5, the intermeshing teeth 101 of the cap and the teeth 12 of the applicator head are a tight fit being arranged to exactly match, within normal manufacturing tolerances, so that there is substantially no clearance between any given tooth and the groove into which it fits, i.e. one end, the apex, and two sides of the tooth each abut the corresponding surface of the groove into which it fits.

The reciprocal arrangement of the teeth and the grooves will in fact be more resistant to torsional force as their respective helical (or reciprocal skewed) arrangements will tend to force them more closely together as the cap is twisted in the screw-off direction. In the embodiment shown the direction of twisting off of the cap is anticlockwise (as viewed from above). The groove/teeth arrangement resists more strongly torsional forces applied to them by anticlockwise rotational forces applied to the cap. The cap and applicator could be said to be reverse threaded as compared to the screw-on direction of rotation for applying a cap to a container. For example if the screwthread of the cap and the neck of the container is a right hand thread then the grooves and teeth from a left hand arrangement, and vice versa. The result is that there is provided very large resistance to the applicator and the cap becoming disengaged when torsional force is applied to remove the cap.

It will be appreciated that providing a container with an applicator cap is simplified in least in as far as the cap and applicator do not have to be assembled in a separate step and a single action (placing the cap on the container) achieves two desired effects—closing the container and assembling the applicator cap for its component parts.

The container may be (part-) filled with any type of flowable product for example liquids or gels. In a preferred embodiment the container is (part-) filled with a CA-type adhesive material. Due to the reaction of the CA-type material with normal plastics it is necessary to manufacture the portion of the applicator cap 1 that will be in contact with the CA materials of suitable CA resistant materials. Suitable materials chosen for such manufacture include LDPE, HDPE or PP.

As the cap 3 does not contact the CA-type material, it is not necessary to manufacture the closure means 3 from the same type of plastics material as is required for the stem 8. Plastics or grades of plastics may be used which are not normally considered CA compatible. The container 2 is suitably manufactured from material such as a CA compatible grade of LDPE, HDPE or PP.

As stated previously, the use of such a construction allows the cap to be manufactured of coloured plastics.

Figure 7:
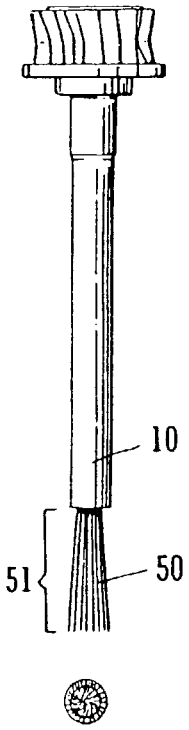
FIG. 7 is an elevational view and (partial) underneath plan view of the applicator with an applicator element in the form of a brush.

As shown in FIG. 7, the free end 11 of the stem 10 may comprise conventional bristles 50 typically manufactured from nylons or polypropylene. Nylons generally, and some grades of polypropylene are not considered to be CA compatible. The bristles 50 form an applicator element 51. The bristles may be incorporated into the stem 10 using conventional methods.

Alternative applicators having various applicator elements are shown in FIGS. 7-24. In these alternative embodiments the applicator element 51 is an integrally moulded flexible applicator 51. The applicator 51 may be provided in a variety of specially designed shapes capable of achieving an application of product similar to that achieved using the multifilament brush of FIG. 6. The applicator element 51 may be shaped for a particular purpose. In each of FIGS. 7-24, the applicator stem 10 and applicator element 52 are integrally formed by integrally moulding techniques. Materials such as low density polyethylene (LDPE), high density polyethylene (HDPE), low density polyethylene/high density polyethylene (LDPE/HDPE) blend or possibly polypropylene (PP) may be used to form the applicator 51 and applicator element 52. The LDPE/HDPE blend may be used in forming any of the components of the assembly.

The varying shapes of applicator element 51 examples of which are illustrated in FIGS. 8 to 23 can be specifically constructed for the type of application and/or the product to be applied.

Figure 8:
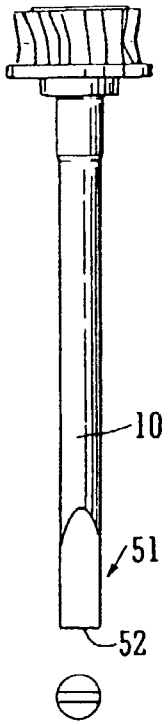
FIGS. 8 to 30 show elevational views and (partial) underneath plan views of various applicators having integrally moulded applicator elements of varying shapes and/or configurations.

For example FIG. 8 illustrates one embodiment where the integrally moulded applicator element is a flat blade or spatula-shaped applicator with a flat tip 52. The tip 52 is flat ended having a straight edge which is substantially orthogonal to the stem 10. This shape of applicator element is useful for light application of product i.e. for relatively small quantities of product. An underneath plan view of the applicator element 51 is also shown beneath the main drawing.

Figure 9:
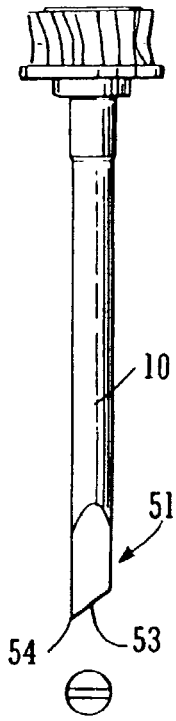

FIG. 9 illustrates another embodiment where the integrally moulded applicator element 52 has a tip 53 which also has a straight edge, but unlike FIG. 8, the straight edge is formed at an angle to the stem 10. The provision of the angled or wedge-shaped tip 53 allows for precise application of product, particularly from leading corner 53. The angled tip allows for a more natural position to be adopted by the hand of the person applying the product as the applicator is designed to be held at an angle to the substrate to which the product is to be applied. Any convenient angle can be used. For most purposes an angle in the range from 10° to 80° between the tip 53 and the stem 10 will suit. An underneath plan view of the applicator element 51 is also shown beneath the main drawing.

Figure 10:
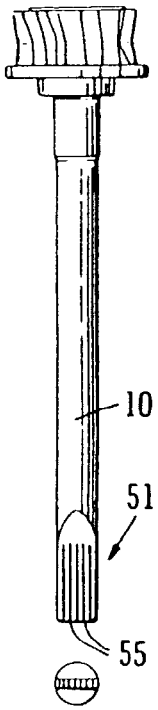

FIG. 10 shows a further alternative applicator element 51. In the arrangement shown the applicator element 51 is formed by a series of individual or discrete filaments 55. The filaments 55 are capable of independent movement mimicking the action of the brush applicator of FIG. 7. Each filament 55 is integrally moulded with the stem 10 and are separated each from the next. The filaments 55 are aligned side by side in a row across the applicator element 51 as can best be seen from the underneath plan view of the applicator element 51 shown beneath the main drawing. The filaments 55 flex to a greater extent relative to those applicators having unitary applicator elements and stems allowing good control of application of product by the filaments.

Figure 11:
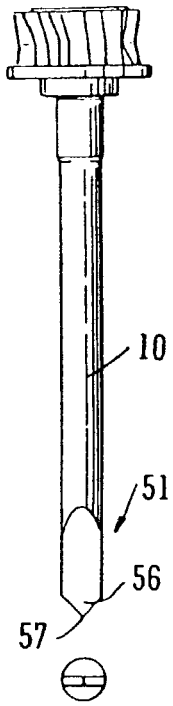

FIG. 11 shows a "chisel-shaped" or pointed applicator element 51. The tip 56 of the applicator element is pointed, having a v-shaped point or nose 57. In common with FIG. 9 the tip is angled though in the present arrangement the angled point is provided at the centre of the tip rather than at one corner. The embodiment of FIG. 11 is suited to precise application of product. It is particularly suitable for precise dot application of product. An underneath plan view of the applicator element 51 is also shown beneath the main drawing.

Figure 12:
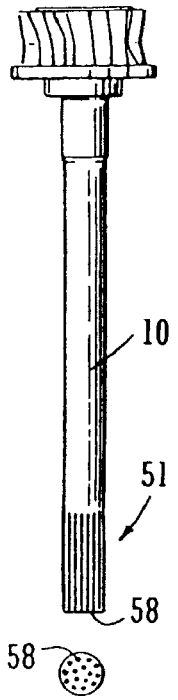

FIG. 12 shows an applicator element 51 formed by a series of individual or discrete filaments 58 similar to the embodiment of FIG. 10 and again mimicking the brush applicator of FIG. 7. The filaments 58 are capable of independent movement. Each filament 58 is integrally moulded with the stem 10 and are separated each from the next. In contrast to the embodiment of FIG. 10, and as best seen from the underneath plan view of the applicator element 51 shown beneath the main drawing, the filaments 58 are offset in two directions i.e. offset to the side and forwardly and rearwardly of each other. The arrangement closely mimics the arrangement of the brush filaments of FIG. 7. The filaments 58 flex to a greater extent relative to those applicators having unitary applicator elements and stems allowing good control of application of product by the filaments.

Figure 13:
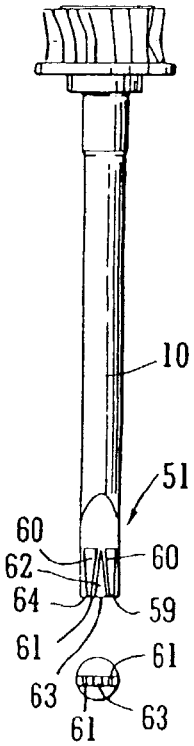

FIG. 13 shows a further applicator. The applicator element is formed by a flat blade or spatula shaped applicator element 51 with a tip 59 with a straight edge 64. Formed in the applicator element surface are grooves or recesses 60. The outer grooves 60 are generally in the shape of an inverted triangle with one open apex of each groove extending to the edge of tip 59. A third (inner) groove 62 in the form of an upright triangle is positioned between the two outer grooves 60. The triangular groove 62 has an open base 63 which opens to the edge of the tip 59. The recessed grooves allow more product to be held by the applicator element 51. An underneath plan view of the applicator element 51 is also shown beneath the main drawing. Product within the well of the grooves will not be wiped off by the wiping blade of an insert so that it is feasible to retain larger amounts of product on the applicator than would otherwise be possible.

Figure 14:
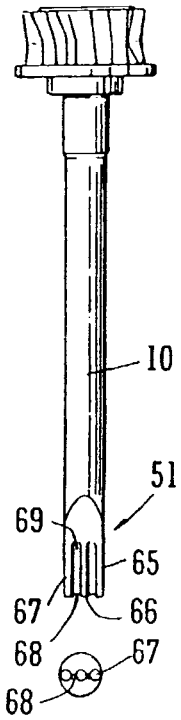

FIG. 14 shows a yet further embodiment again designed to hold a larger amount of product than would otherwise be possible. In the embodiment the applicator element 51 is again a flat blade or spatula shaped with a tip 65 with a straight edge 66. As best seen from the underneath plan view shown beneath the main drawing the applicator element 51 is formed from a series of three rods 67 which are substantially circular in cross section. The rods 67 extend along the surface of the applicator element and are spaced apart with their respective longitudinal axes substantially parallel to each other and also substantially parallel to the longitudinal axis of the stem 10. Between and connecting the rods 67 are flat ribs 68. The diameter of each of the rods 67 is greater than the thickness of the ribs 68 so that the rods and ribs together define recessed areas 69 (on opposing sides of the applicator elements) which can also be used to hold relatively large amount of product.

Figure 15:
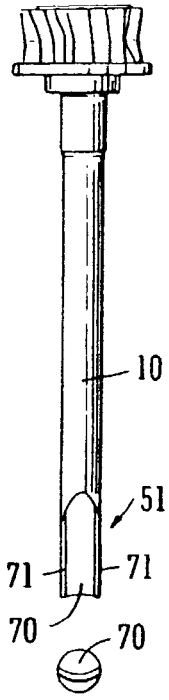

FIG. 15 is another example of an applicator element which is useful in the present invention. The applicator element 51 is moulded to form a round bottomed (concave) channel or recess 70 as can be seen from both the main drawing and the underneath plan view shown beneath the main drawing. The opposing sides 71 of the channel 70 curve upwardly so that the channel is capable of holding relatively large amounts of product. Again, as with all embodiments of applicator elements of the present invention the applicator element is flexible i.e. flexes when forced again a substrate by relatively weak manual forces applied to the applicator. Also in common with all the applicators described, the stem and applicator elements are integrally moulded.

Figure 16:
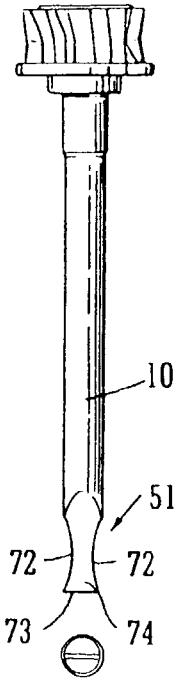

FIG. 16 shows a similar applicator element 51 to that of FIG. 15. In this arrangement the sides of the applicator element are also concave having narrowed shoulder portions between the flat edge 73 of the tip 74 and the stem 10.

Figure 17:
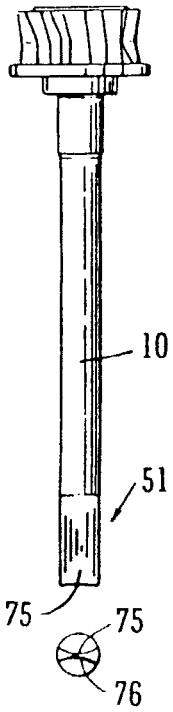

A further applicator 10 is shown in FIG. 17. In the drawing and as best seen from the underneath plan view of the applicator element 51 the applicator element has two concave surfaces 75, 76 on opposing faces of the applicator element 51. Again the main function of the depressed areas on each side of the applicator element is to hold and retain larger quantities of product.

Figure 18:
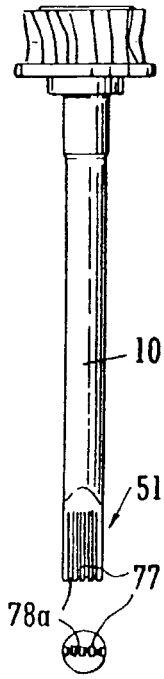

A similar embodiment to that of FIG. 14 is shown in FIG. 18. In this embodiment there are provide a series of closely spaced rods 77. A small discrete recessed area **78*a* is found between each two consecutive rods 77. This arrangement is designed to hold more product. The rod 77** projects proud of the respective surfaces of the two opposing faces of the applicator element.

Figure 19:
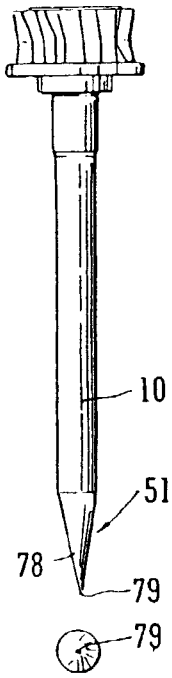

FIG. 19 shows an applicator element 51 in the form of a conical or pointed tip 78. The tip 78 ends in a sharp point 79. This arrangement is particularly useful for precise application of relatively small amounts of product. In particular the arrangement is useful for point application of small discrete drops of product. The applicator element is optionally flexible.

Figure 20:
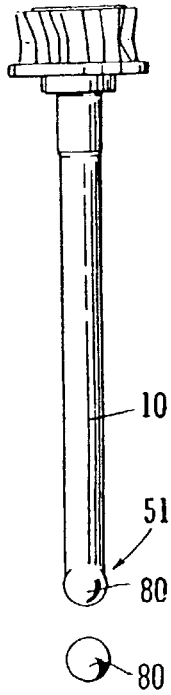

FIG. 20 shows an applicator element 51 which is part spherical or "ball-shaped". The applicator element has a ball-shaped portion 80 which is particularly useful for application of drops or dots of product. With this applicator the product can be used to drop or dot product rather than being used to smooth product onto the surface by flexing. The applicator element is optionally flexible.

Figure 21:
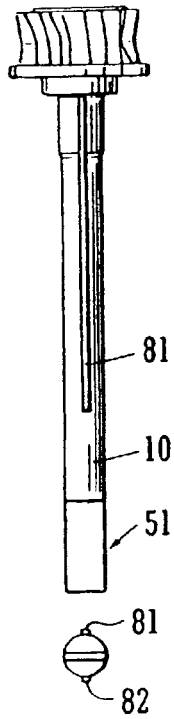

FIG. 21 is provided to illustrate one method of reinforcing or strengthening the stem 10 of the applicator. Two opposing ribs 81, 82 (which are best seen from the underneath plan view) of square cross section are provided. The ribs 81, 82 are integrally moulded with the stem 10 and provide the stem 10 with further resilience to flexing or bending under pressure. One or more reinforcing ribs which run along the stem and which may be integrally formed with it, could be provided on any of the stems provided on the applicators which form part of the invention.

Figure 22:
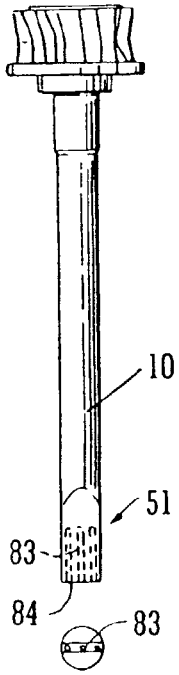

FIG. 22 shows an applicator element 51 which is particularly useful with products of relatively low viscosity such as liquids. The applicator element 51 has a series of cylindrical inlets or conduits 83 defined within its body which open out to the straight edge 84 of the tip. The cylindrical inlets are dimensioned so as to uptake product by capillary action when the applicator element is placed in contact with a liquid product.

Figure 23:
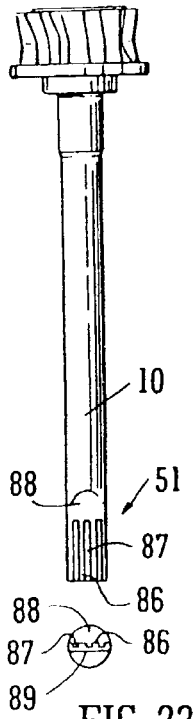

FIG. 23 generally shows an applicator element 51 with a series of flat ribs 86 between which are a series of channels 87 into which product can be taken. In the embodiment shown the ribs 86 are provided on one (upper) surface 88 of the applicator element and project proud thereof. The lower surface 89 has no ribs and is flat. It is generally true of the embodiments described herein that whichever retaining means for product is formed on the applicator element may be formed on one or both sides on the applicator element.

Figure 24:
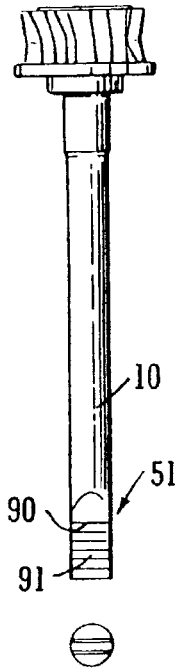

FIG. 24 shows a further alternative where the applicator element 51 is provided with a series of transverse ribs 90 which define transverse channels 91 which take up and retain product.

Figure 25:
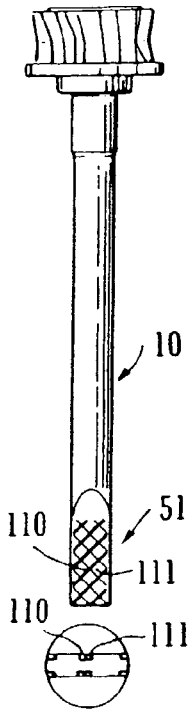

FIG. 25 shows a further applicator with a alternative applicator element 51. The applicator element 51 is generally as described in FIG. 8. The applicator element 51 has a series of ribs 110 running from left to right (and parallel to each other) across the surface of the applicator element. A second series of ribs 111 run from right to left (again parallel) down the applicator element. Both sets of ribs 110 and 111 interlock forming a diamond-shaped array. An enlarged (partial) underneath plan view of the applicator is also shown with the ribs 110, 111. The ribs are formed on the surface of the applicator and therefore create a raised surface. The diamonds form discrete reservoirs for the product.

Figure 26:
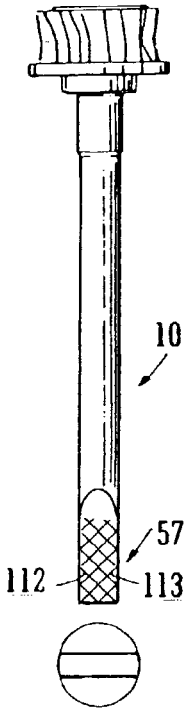

FIG. 26 shows an a further applicator with an applicator element 51 with the series of channels 112 running from left to right across and down the applicator. A series of channels 113 run from right to left down the applicator. The channels intersect to form a diamond formation. The channels 112, 113 are formed in the surface of the applicator element. The channels 112, 113 are thus recessed in the applicator element. The channels aid retention of product on the applicator element.

Figure 27:
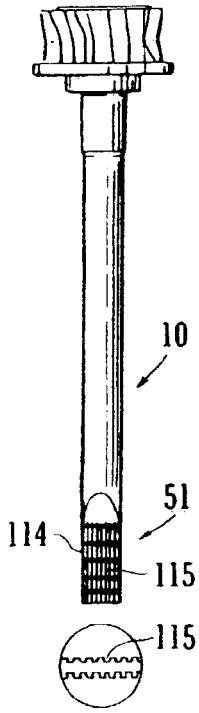

FIG. 27 shows a further applicator with a yet further alternative applicator element 51. The applicator element has a series of transverse (substantially parallel) ribs 114 running across the applicator element. A series of longitudinal ribs 115 (again substantially parallel to each other) run down the applicator element. The series of ribs 114 and 115 intersect (substantially perpendicular to each other) to form a grid pattern. The grid pattern forms a series of rectangular shaped reservoirs which retain product.

Figure 28:
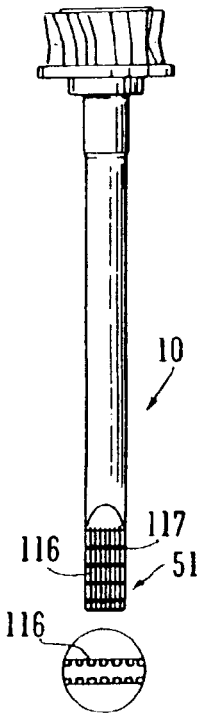

FIG. 28 shows an applicator with an alternative applicator element 51. In this embodiment a series of longitudinal channels 116 which are substantially parallel, run along the applicator element. A series of transverse channels 117 run across the applicator element substantially parallel to the longitudinal channels 116. Both sets of channels are formed in the surface of the applicator.

Figure 29:
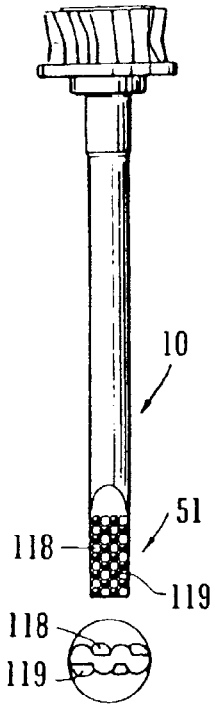

FIG. 29 shows an applicator 10 with an applicator element 51 a series of raised bumps 119 extending across the applicator element surface. Between the bumps 119 are formed reservoirs 118 for holding product.

Figure 30:
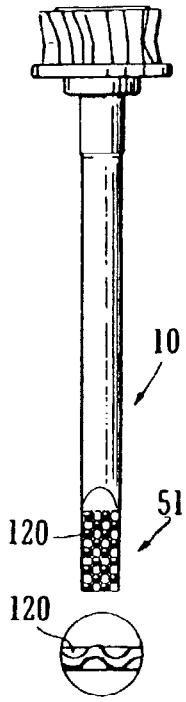

FIG. 30 shows an arrangement where a series of depressions are formed in the surface of the applicator element. Each of the depression 120 acts as a reservoir to hold the product. For each of FIGS. 25-30 the applicator element is integrally formed with the stem. It is also flexible. The arrangement provided on the applicator element can, as shown, be provided on both faces of the applicator element or in alternative on one face only.

The advantages of using an integrally moulded applicator portion include the following:

the stem and applicator element are easily produced; a brush filament component may be eliminated if desired which eliminates the necessity for a wash treatment; the applicator is more robust than brush applicators and particularly in shipping and production processes the applicator can be moulded in CA compatible materials (no subsequent treating required); there are no bristles to fall out, to be damaged or to be splayed during use; moulding of the applicator element to a particular shape/configuration can be readily achieved.

Also provided is a container for holding product, the container comprising:

a) an elongate tube for holding product, the tube comprising a tubular body having side walls with interior and exterior surfaces, a lower end, and a top end with an opening through which product can be removed, the tube further comprising a collar formed about the exterior surface of the side walls and proximate the opening of the tube; and b) a holder for the tube, the holder comprising a hollow body with a top end, a base end and side walls, the top end having a seat defined by wall portions of the body about an aperture defined therein and in which the collar of the tube is engageable so that the top end of the tube projects proud of the top end of the holder and that part of the tube body from the collar to its lower end extends into the body, the body being dimensioned so that the lower end of the tube extends to a position flush with, or shy of, the base end of the body.

The holder body holds the tube in an upright position where it is conveniently accessible. The tube is securely held so that even robust handling will not upset it. If the tube is round ended as often they are, it would not stand alone without the holder. The collar is suitably snap-fit engageable with the body (and within the aperture). For ease of use it is desirable that the tube is held at an angle. In this embodiment the mouth of the container will face upwardly and in one direction so that, in use the mouth of the container may be angled (face) toward a user of the container. The tube may be held at an angle of between 20° and 85° to the horizontal suitably between 30° and 80 for example between 35° and 55° and often about 45°. This may be achieved by angling the base of the body. However it is preferred to angle the seat to achieve the desired orientation of the tube for example to achieve the angle of orientation referred to above.

Suitably the base end is open being defined by the lower end of the side walls. This allows a particularly simple construction. Suitably the body is divergent along its length so that the periphery of its base end is larger than that of its top end.

In one convenient arrangement both the periphery of the collar and of the aperture are circular so that the collar is engageable in the seat at a number of different relative positions of the seat and the collar. Suitably the seat is formed by a stop about the periphery of the aperture, and a lower series of grips formed on the interior of the body, beneath and spaced from the stop, the collar being snap-fit engageable between the stop and the grips.

It is preferred that the stop is a segmented rim so that there are breaks between rim portions and that the grips are coincidental with the breaks between the rim portions, the collar having recesses to engage the rim portions. This arrangement allows for a particularly secure snap-fit of the components. Desirably the tube and the holder are held against relative rotational motion. Suitably above the tube has circular cross-section a least one flat surface is provided on the tube to allow for ease of gripping.

The aspect of the invention just described will now be described with respect to FIGS. 31-43.

Figure 31:
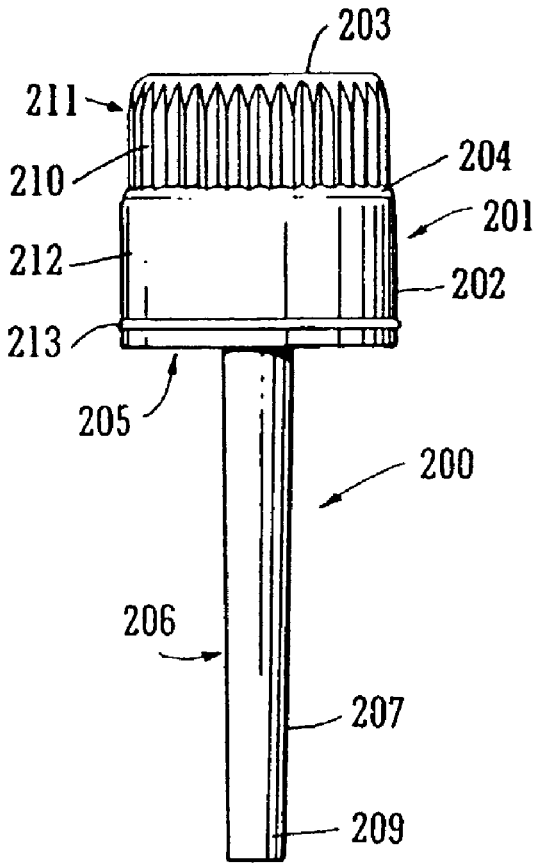
FIG. 31 shows a side elevational view of an applicator cap for use in a second aspect of the invention.
Figure 32:
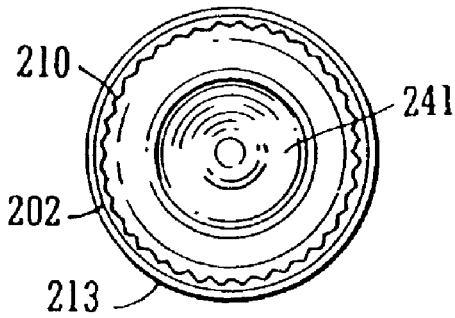
FIG. 32 shows a top plan view of the applicator cap of FIG. 31.
Figure 33:
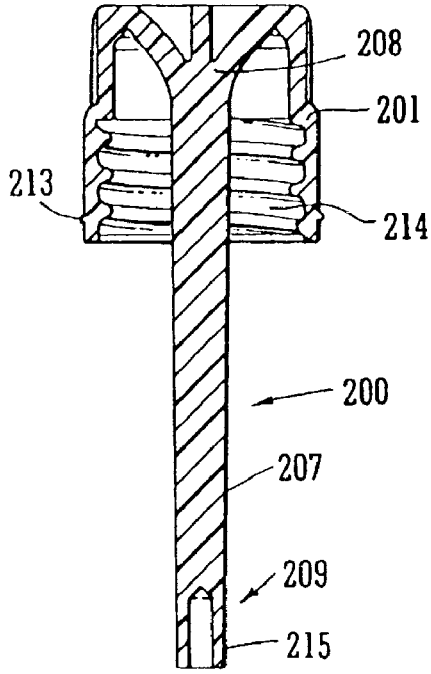
FIG. 33 shows a cross-sectional view of the applicator cap of FIG. 31.

FIGS. 31 to 33 show an applicator cap 200 which forms part of a cap assembly for closing a container. While the embodiment described refers to an applicator cap it will be appreciated that the assembly need not comprise an applicator cap. The applicator cap has an undercap 201 with a cap body 202. The cap body has a top end in the form of a top wall 203 and also has a side wall 204 depending from the top wall 203. The side wall 204 (together with the top wall 203) forms a housing 205 for receiving the neck of a container as will be described later. The applicator cap 200 also comprises an applicator 206 with an applicator stem 207. The stem 207 has a first end 208 which is integrally formed with the undercap 201 within the housing 205. The stem 207 could also be snap-fit or otherwise engageable in the undercap 20. The stem 207 projects from the housing and has a free end 209 for applying product. The free end 209 could be in accordance with any of the embodiments of the invention described, for example with reference to FIGS. 8-30.

A top view of the applicator cap 200 is shown in FIG. 32. As best seen from both FIGS. 31 and 32 the exterior of the undercap body 202 is provided with a series of circumferentially arranged, radially outwardly projecting teeth. The teeth are arranged substantially parallel to each other. The teeth 210 run parallel to a central longitudinal axis of the applicator cap. The teeth are formed on a top portion 211 of the cap body 202 which is slightly shorter in diameter than a lower portion 212. A circumferential rim 213 travels about the body 202 of the cap and forms part of a snap-fit mechanism which will be described in more detail below. The undercap has a dished surface 241 where the stem 207 is integrally moulded to the undercap.

A cross-sectional view of the applicator 200 is shown in FIG. 33. The first end 208 of the applicator end 207 is shown integrally moulded with the cap 201. The stem has an aperture 215 at its free end 209. The aperture 215 may be used for the attachment of brush filaments etc. to the stem 207. Alternatively the fee end 209 could be provided with any suitable applicator tip such as those described above with reference to FIGS. 7 to 30. It will also be appreciated that the arrangement described with reference to FIGS. 1 to 6 for attachment of an applicator to a cap could be used also.

Figure 34:
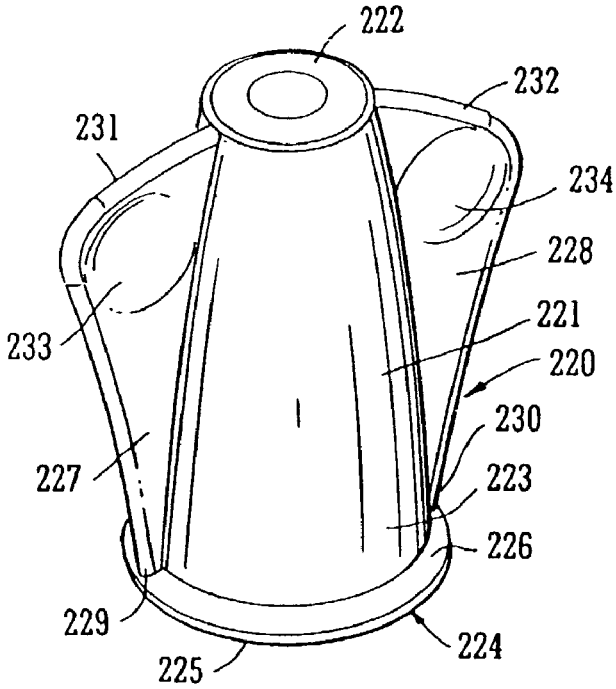
FIG. 34 shows a perspective view of an overcap suitable for use in a cap assembly with the applicator cap of FIG. 31.

FIG. 34 shows an overcap 220 which has an overcap body 221 with a top end 222 and an endless side wall 223 depending from the top end wall 222. The overcap 220 has a housing 224 which is designed to fit over and engage with the undercap 201. The overcap body 221 tapers from the mouth 225 of the housing 224 until it reaches the top wall 222 so that it is of a general frusto-conical shape. The mouth 225 is encircled by a rim 226. Two opposing grips 227, 228 are integrally moulded with the overcap body 221. The grips project from the exterior of the overcap body. The grips 227, 228 generally take the form of two opposing wings one on either side of the overcap body. The grips 227, 228 are substantially planar, being substantially less in thickness than the diameter of the overcap body at any given point. While the overcap tapers inwardly from the mouth 225 to its top wall 222, the outer edges of the grips 227, 228 taper outwardly from their respective lower ends 229, 230 to their upper ends 231, 232. The grips 227, 228 are generally triangular or wedge-shaped. For further ease of manual gripping, two finger grips 233, 234 are formed in the grips 227, 228. The finger grips 223, 234 each comprise a lens-type grip or indentation each of which is formed as part of the grip surface. Each also has a part-spherical raised surface respectively labelled 235, 236, (see FIG. 37) which have corresponding depressions 237, 238 on the opposing side of each of the raised surface 235, 236.

Figure 35:
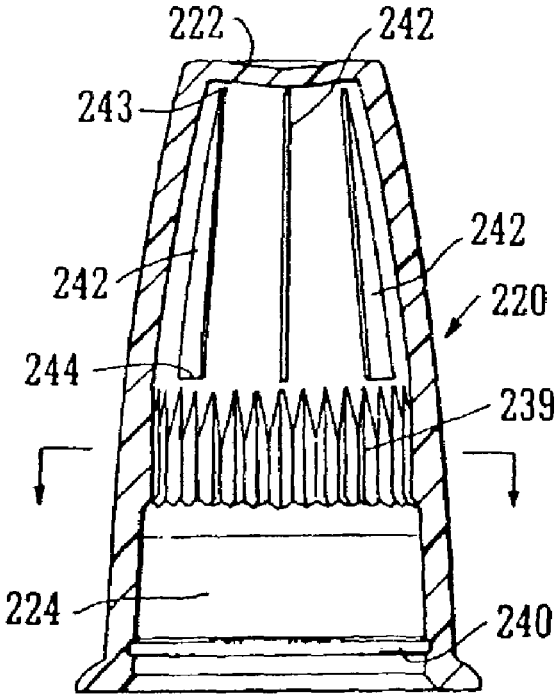
FIG. 35 shows a side-sectional view of the overcap of FIG. 34.
Figure 36:
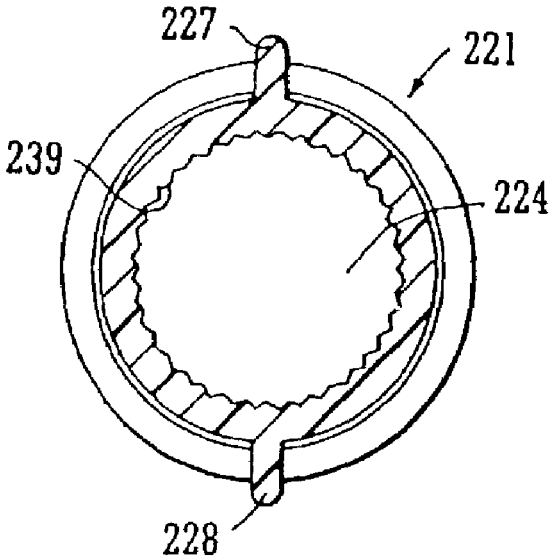
FIG. 36 shows a cross-sectional view of the overcap of FIG. 34 as indicated by the arrows in FIG. 35.
Figure 37:
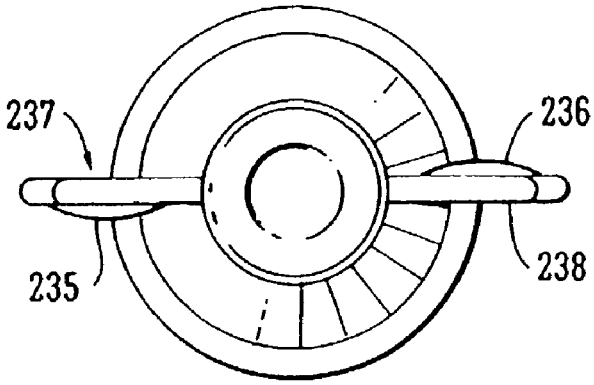
FIG. 37 shows a plan view from above the cap of FIG. 34.
Figure 42:
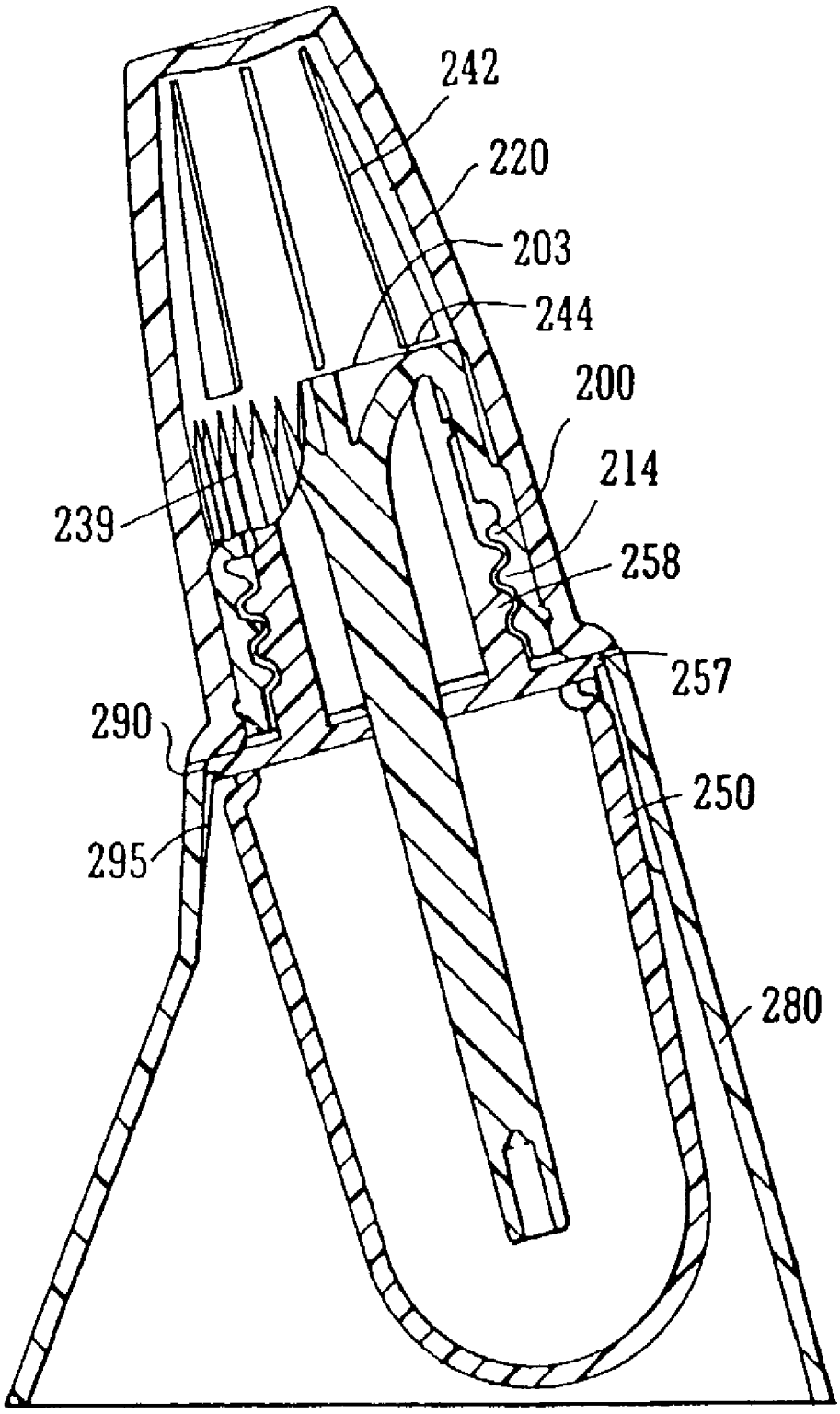
FIG. 42 shows a cross-sectional view (from the right side) of the assembly of FIG. 41.
Figure 43:
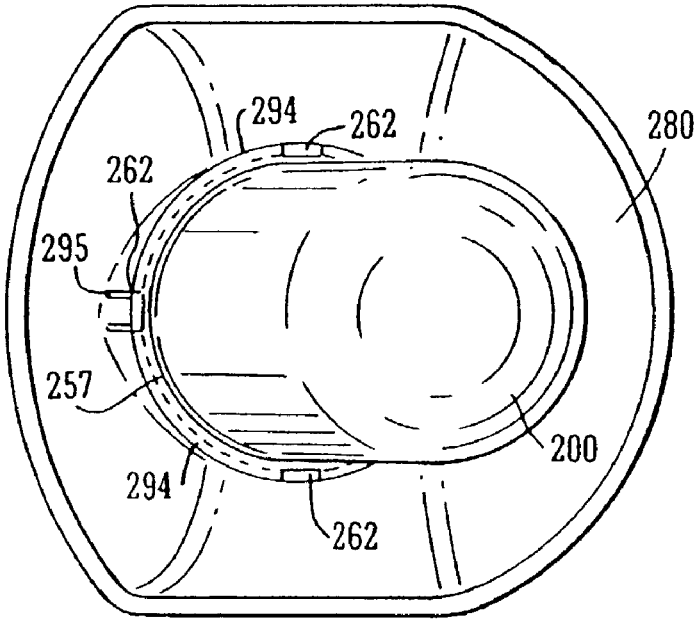
FIG. 43 shows a part sectional view from above of the holder of FIG. 39 with the container of FIG. 38 snap-fitted into the holder.

As best seen from FIGS. 35, 36 and 42 a set of circumferentially arranged radially inwardly projecting teeth 239 are formed on the interior of the cap body 221 and project radially inwardly into the housing 224. The teeth 210 on the applicator cap 200 are reciprocally formed to interengage or mesh with the teeth 239 within the housing 224 of the overcap 220. Suitably there are 36 teeth, both on the applicator 200, and on the overcap 220, there are thus 36 positions at which the overcap and the applicator will mate. This allows the undercap 201 to be screwed onto the container. The overcap 220 can then be fitted over the applicator cap at a desired orientation to the container on which it is being placed. The overcap 220 and the applicator cap 200 engage by snap-fitting of the rim 213 on the undercap body 202 within a recess 240 formed on the underside of the overcap 220. The snap-fit is a non-return snap-fit locking the two components together. The components are held firmly together so that, in contrast to the further embodiment to be described below there is no degree of axial freedom between the overcap and the undercap as they are held against relative rotational and also against relative axial movement.

A container/holder arrangement to which the cap assembly described above is suitable for attaching will now be described with reference to FIGS. 38-42. The container comprises two parts, an elongate tubular container 250 shown in FIG. 38, and a holder 280 for the tubular container shown in FIGS. 39 and 40. The elongate tubular container 250 which is used for holding product has a tubular body 251 with side walls 252 and a lower round bottomed end 253. The tube 250 also has a top end in the form of a neck 254 with an opening 255 defined by a mouth 256 on the neck 254. The tube has a collar 257 formed about the exterior surface of the side walls (in the embodiment shown about the lower end of the neck 254). The collar 257 is located at a position on the tube 250 closer to the opening 255 than to the lower end 253. Also provided on the neck 254 of the container are screw-threads 258 and an anti-drip ring 259 which is designed to stop product spilled on or about the mouth 256 from running onto the screw-threads 258. The anti-drip ring 259 slopes gradually downward in a curve from a highest point 259 on each side of the tube about opposing sides of the tube meeting itself to form an endless ring at two v-shaped junctions 264, one to the front, the other to the rear of the tube 250. In the assembled arrangement (see FIGS. 41 and 42) where the tube is held in an inclined position, the anti-drip ring is arranged to project under the mouth of the tubular container to collect spilled product which runs down the exterior of the neck 254 from the mouth 256. The screw-threads 258 are arranged to interengage with the screw-threads 214 on the underside of the applicator cap 206 described above. The periphery or outer edge 260 of the collar 257 is circular. The collar is also provided with recesses or cut-out portions 261 which each extend for a part of the width of the collar and for a part of the thickness of the collar. There are four recesses 261 provided in the embodiment shown. The non-recessed portion of the collar between the recesses 261 form tabs 262. The collar 257 allows the tube 250 to be engaged in a holder 280 as will be described in more detail below. The container 250 is also provided with a flat surface 265 (one each side of the container) to allow for ease of handling of the container and in particular ease of holding against rotation for example when a cap (assembly) is being applied.

Figure 39:
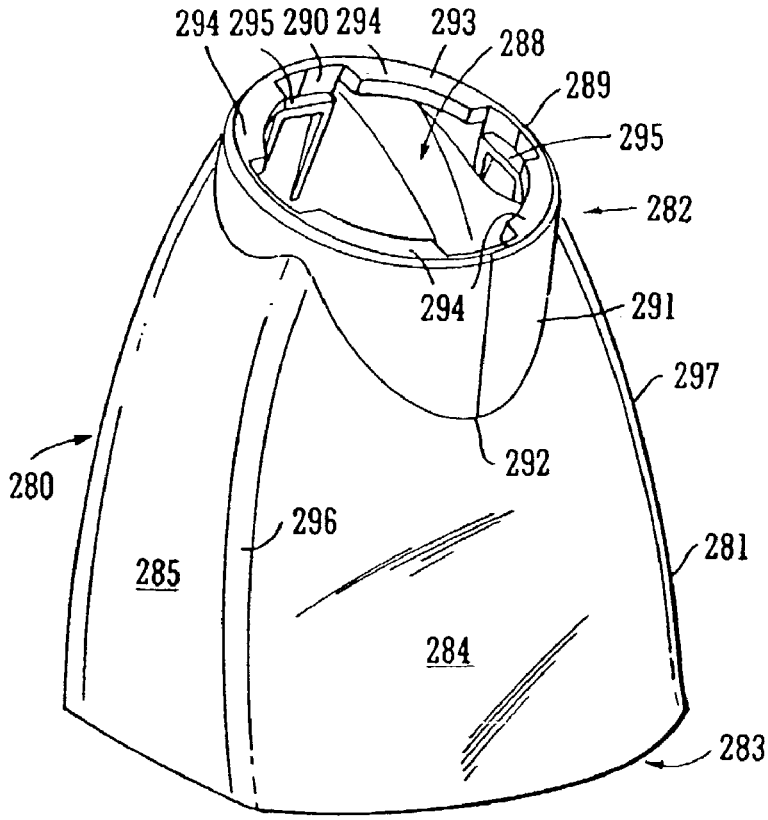
FIG. 39 shows a perspective view from the front and left side of a holder suitable for holding the container of FIG. 38.
Figure 40:
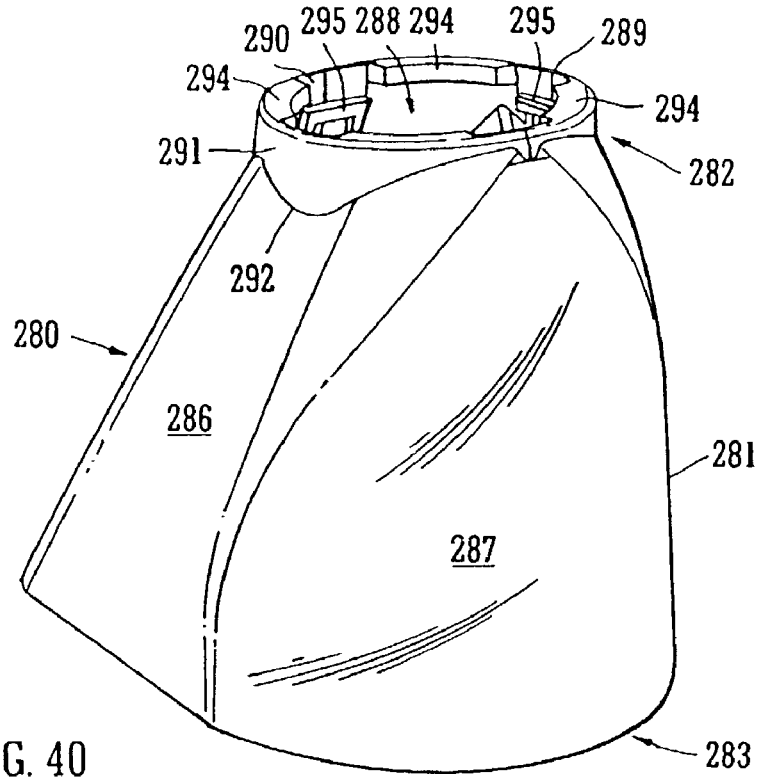
FIG. 40 shows a perspective view of the holder of FIG. 39 from the rear and right side.

The holder 280 is shown from a front (and left) perspective view in FIG. 39 and a rear (and right) perspective view in FIG. 40. The holder 280 comprises a hollow body 281 with a top end 282 and a base end 283. The holder 280 has side walls (in a skirt arrangement) running between the top end 282 and the base end 283. In particular the holder 280 has a front wall 284, a right side wall 285, and a left side wall 286, and a rear wall 287. An aperture 288 is defined in the top end 282 of the holder 280. The aperture 288 is formed by wall portions 289 of the body 281.

The base end 283 is open, being defined by the lower ends of the side walls 284-287. The hollow body 281 forms a housing within which part of the tube 250 can be located as will be described below.

The hollow body 281 is divergent (increases in girth) along its length from its top end 282 to its bottom end 283. The seat 290 formed by the wall portions 289 of the body 281 is provided on a neck portion 291 which is integrally formed with the hollow body 281. The neck portion 291 meets the body 281 along a joint line 292. As can be seen from the drawings particularly FIGS. 39 and 40, the neck 291 is arranged at an angle to the body 281. The seat 290 is formed in part by a stop in the form of a segmented rim 293 on the interior of the neck portion 291. There are four segments 294 to the segmented rim 293. The segmented rim is formed on the interior surface of the body 281 and project radially inwardly into the aperture 288. A series of (four) grips 295 formed on the interior of the body 281 are positioned beneath and spaced from the segmented rim 293 and also form in part the seat 290 for the collar. Each grip 295 is coincidental with the breaks or spaces between the rim portions 290. The space between the grips 295 and the segmented rim 293 about the interior wall of the neck portion 291 forms the seat for the collar 257.

Figure 41:
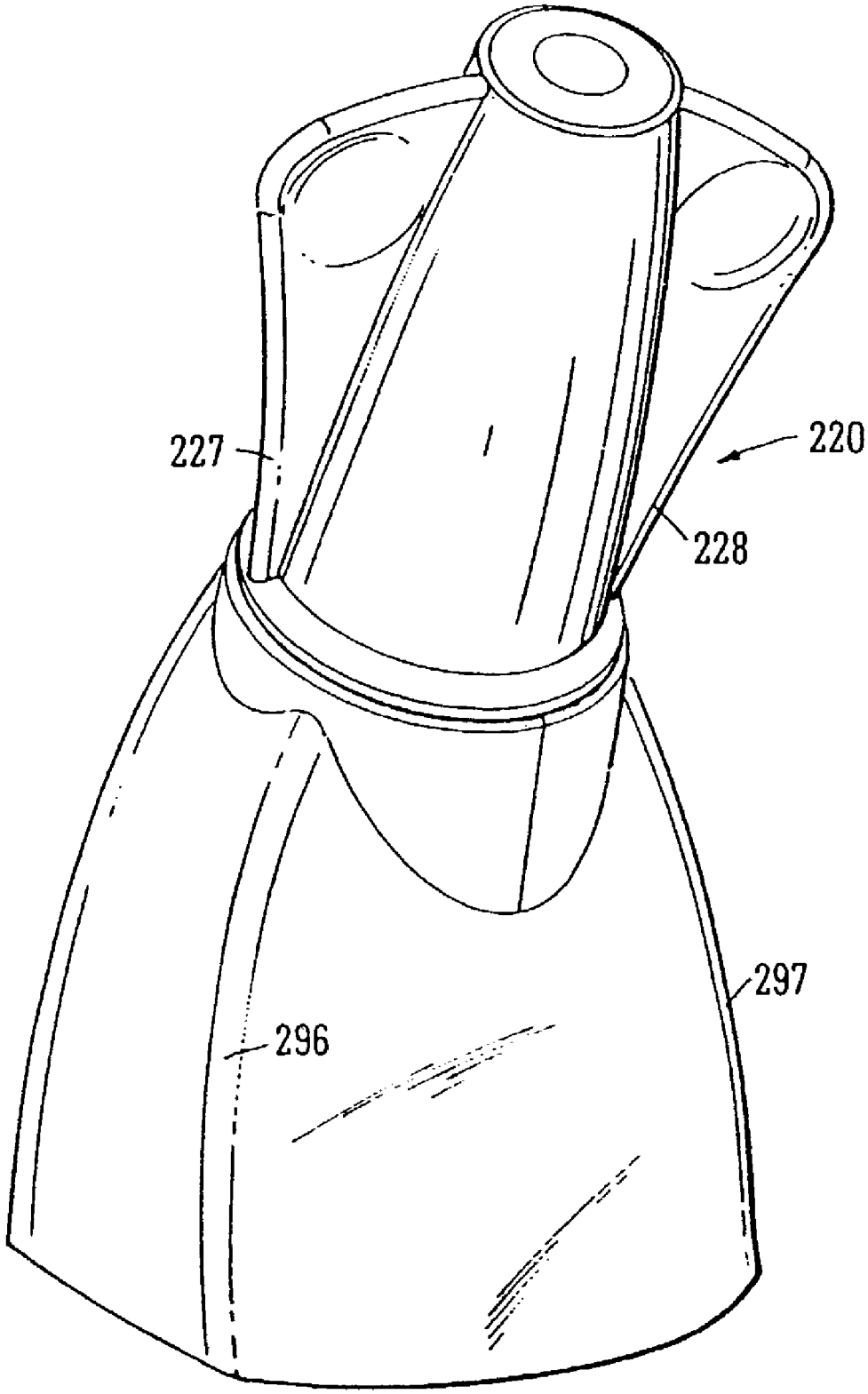
FIG. 41 shows a perspective view of the holder of FIG. 39 and the container of FIG. 38 and the cap of FIG. 34 assembled together.

The assembled arrangement of the applicator cap 200, the overcap 220, the tubular container 250 and the holder 280 is shown in perspective view in FIG. 41 and in side-sectional view in FIG. 42.

The full container is assembled as follows:

The tubular container 250 is snap-fitted into the holder 280 to the position shown. In particular the collar 257 is snap-fitted into the seat 290 and held in place by the segmented rim 293 and the grips 295. Once in place the tubular container is not easily removed, the snap-fit being a non-return snap-fit locking the components together. The recesses 261 on the collar are arranged to mate with each of the segments 294 of the rim 293. The tabs 262 formed by the collar project into the spaces between the segments 294. The mating of the tabs 262 and the segments 294 prevent relative rotation of the tubular container and the holder i.e. the interlocking parts prevent relative rotation also. The tube 250 is inserted into the holder 280 through the open base end 283 thereof. On insertion the tabs 262 are aligned with each of the grips 295. Continued movement of the tube 250 moves the neck 254 until it extends through the aperture 288, and snap-fit engagement of the collar 257 in the seat 290 is achieved. It is desired that one of the highest positions (crests) 259 of the antidrip ring 259 is oriented to face in the same direction as the front wall 284 of the holder 280. In this orientation it best catches drips from the mouth of the container which tend to flow toward the v-shaped junctions. The tabs 262 force the grips 295 apart to a degree. Once the tabs 262 pass the grips 295 the collar snap-fits into the seating due to the resilience of the grips. If desired product may then be placed in the container. The applicator cap 200 is then screw-threaded onto the tube 250 by engagement of the screw-threads 214 on the applicator cap with the corresponding screw-threads 258 on the neck 254 of the tube 250.

The cap undercap 200 closes and seals the container. The overcap 220 is then snap-fitted over the applicator cap 200. As described above the relative orientation of the overcap 220 and the applicator cap 200 can be selected so that a desired orientation of the overcap to the container may be selected. For example the grips 227, 228 of the applicator cap 220 may be aligned with edges 296 and 297 on the front wall 284 of the container. The continuity of the lines between the overcap and the container body is pleasing to the eye. It will be appreciated that if the overcap was askew, for example turned through 90° from the position shown, the overall aesthetic appearance of the assembled container would be lessened.

The undercap 200 has also provided on its internal surface a series of (six) teeth 242. The teeth 242 extend from their respective top ends 243 formed at the inner surface of the top wall 222 to their lower ends 244. The teeth 242 are substantially triangular in side profile. The teeth 242 extend down the inside of the overcap 220 until they meet the further set of teeth 239 whereupon they terminate. The lower ends 244 are straight edged along a line substantially perpendicular to the longitudinal axis of the overcap.

When the overcap 220 is snap-fitted to the undercap (such as is shown in FIG. 42) the lower ends 244 of the teeth 242 abut the top wall 203 of the undercap 200. This provides extra stability for the overcap 220 on the undercap 200. A tighter fit of the overcap 220 on the undercap 200 is thus achieved.

While the teeth 242 are clearly not essential in the embodiment of the present invention just described, they are desirable firstly to provide a more secure fit of the overcap on the undercap and secondly as the overcap 220 may be used in the further embodiments of the invention next to be described.

Figure 44:
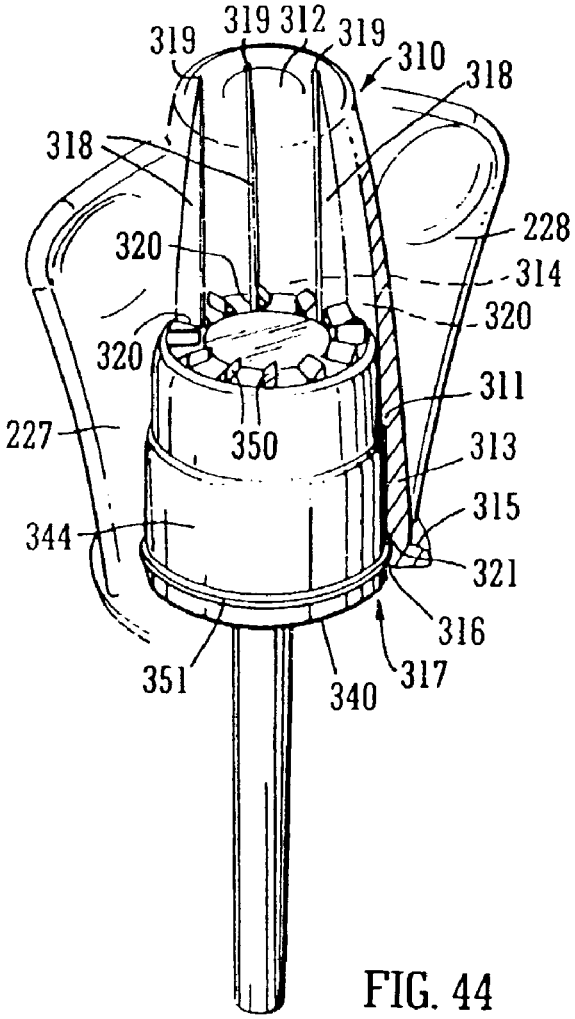
FIG. 44 shows a perspective view of an applicator cap assembly comprising an overcap and undercap for use in a safety cap arrangement, the overcap being shown in a partly cut-away view.
Figure 45:
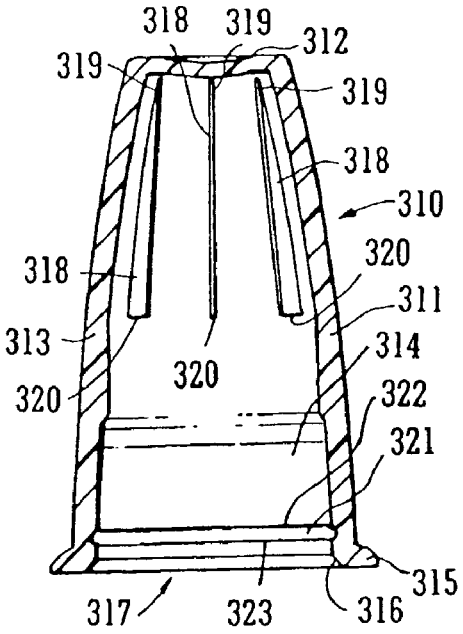
FIG. 45 shows a cross-sectional view of the overcap shown in FIG. 44.

FIGS. 44 and 45 (FIG. 44 in part cut-away view) show an overcap 310 (which may be identical to the overcap just described) with an overcap body 311 having a top end in the form of a top wall 312 and an endless side wall 313 depending from the top wall 312. The overcap body forms a housing 314. The cap body terminates at a lower end 315 where a mouth 316 for the housing is formed. Access to the housing is gained through an opening 317 defined by the mouth 316. The overcap 310 has the same external profile and features (for example grips 227, 228) as the overcap shown in FIGS. 34-37 and as described above. A series of teeth 318 are formed within the housing 314 and may be integrally formed with the housing. The teeth are substantially triangular in side profile. In the embodiment shown the teeth 318 extend downwards from their respective top ends 319 the inner surface of the top wall 312. The teeth 318 are elongate extending approximately half the way down the cap within the housing and terminating at their respective lower ends 320. A total of six teeth 318 are provided while three are shown in the views of FIGS. 44 and 45. Any abundant number of teeth 318 could be used for example from about 2 to about 20.

The lower ends 320 of the teeth 318 are straight edged, the straight edge being substantially perpendicular to the longitudinal axis of the overcap 310. The teeth 318 are circumferentially arranged and project axially downwardly (and radially inwardly) within the housing 314. The teeth 318 form part of a safety cap or "child proof" mechanism by their interaction with an under cap or applicator cap to be described below.

Figure 46:
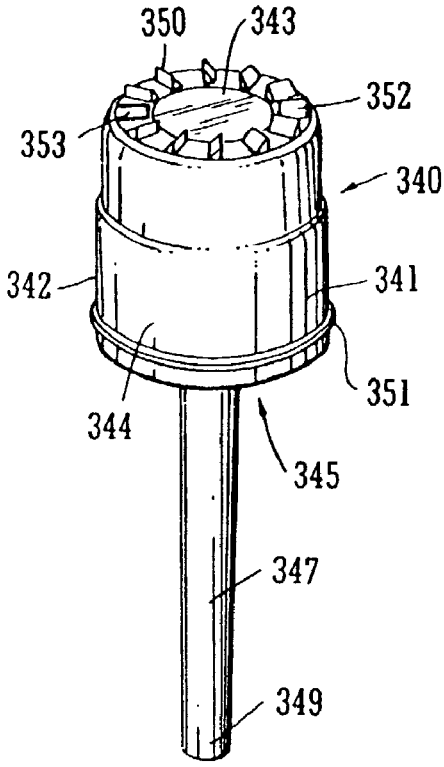
FIG. 46 shows a perspective view of the applicator cap assembly shown in FIG. 44.
Figure 47:
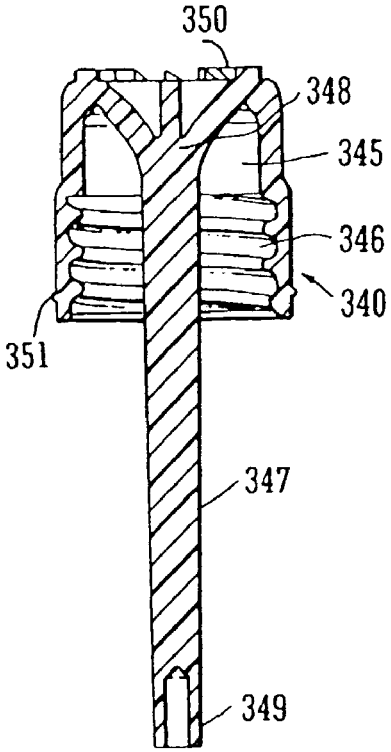
FIG. 47 shows a cross-sectional view of the applicator cap assembly of FIG. 46.

FIGS. 44, 46 and 47 show an applicator cap 340, the applicator cap comprising an undercap 341 with a cap body 342 and a top wall 343. Again, as for the embodiment of the invention described above, the undercap described has an applicator attached. The undercap need not be an applicator cap. Where it is an applicator cap, the method of attaching the applicator to the undercap may be as described in FIGS. 1 to 6, while the applicator element may be as described in any one of FIGS. 8 to 30. The top wall 343 has an endless side wall 344 depending from it to form an housing for receiving the neck of the container. As best seen from the sectional view of FIG. 47 the undercap has internal screw-threads 346 formed in the housing for screw-thread engagement with (reciprocal) screw-threads on the neck of a container. The applicator cap further comprises an applicator stem 347. The stem 347 has a first end 348 which is integrally formed with the undercap within the housing. The stem has a second free end 349 which may be in the form of an applicator element for applying product.

The undercap 340 has a series of circumferentially arranged axially upwardly projecting teeth 350 formed on the top wall 343. The teeth 350 are arranged to interengage with the teeth 318 within the overcap 310. To assemble the cap assembly the overcap 310 is snap-fitted over the applicator cap by engagement of a circumferentially projecting snap-fit rim 351 about the exterior of the side wall 344 within a corresponding recess 321 in the housing 314 of the overcap 310 proximate the mouth 316 of the housing. The snap-fit mechanism retains the applicator cap 340 within the overcap. However, as best seen from FIGS. 48 and 49, due to the relative sizes of the snap-fit rim 351 and the snap-fit recess 321, the applicator cap 340 has a degree (or range) of free axial movement between upper and lower limits defined by respectively the upper 322 and the lower 323 edges of the recess or groove 321. This is due in part of the fact that the rim 351 has a height (measured in the direction parallel to the longitudinal axis of the applicator) of about 0.6 mm whereas the recess has a height (measured in the direction of the longitudinal axis of the overcap) of about 2.5 mm. As the teeth 350 have a height (above the cap) of about 1.0 mm there is thus up to a maximum of about 0.9 mm of clearance (shown diagrammatically in FIG. 48) between the teeth 320 on the underside of the overcap and the teeth 350 on the upper wall 312. The two respective sets of teeth are arranged so that the overcap rides across the teeth on the undercap without interengaging unless downward pressure is applied to the overcap simultaneously while the overcap is (turned) twisted in a direction for unscrewing the applicator cap assembly from a container. However the overcap 310 engages readily with the applicator cap 340 when turned in a direction for screwing the cap assembly onto a container.

In the embodiment shown the interlocking of the overcap and the undercap is achieved using the following construction.

The teeth 350 are generally triangular in shape (wedge-shaped). They have an oblique face or ramp 352 on one side which is the leading face of each tooth in the direction of unscrewing of the cap. The oblique face or ramp is difficult to engage and tends to cause the teeth 318 to ride over the teeth 350 without interengaging. The ramp is planar (flat) in the embodiment shown. It will be appreciated that the ramp could be curved for example concave. The axial freedom of the overcap on the applicator cap 340 allows for sufficient relative movement (parallel to the longitudinal axis of the applicator) for the teeth 318 to pass over the teeth 350 without interengaging.

The opposing side 353 of the teeth is flat or planar and is arranged to stand substantially perpendicular to the top wall of the applicator cap 340. This ensures that the teeth 318 will interengage with the teeth 350 in a direction of screwing on of the applicator cap assembly.

Figure 38:
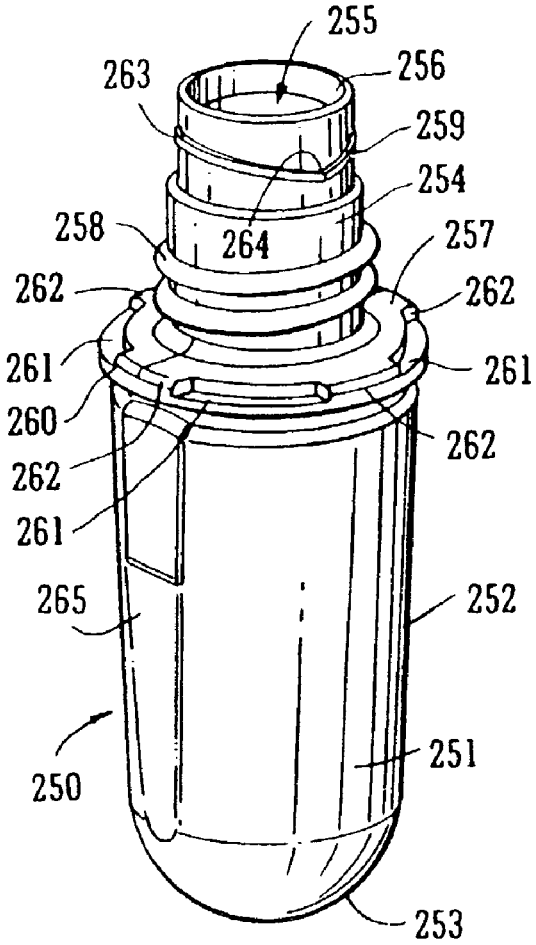
FIG. 38 shows a perspective view of a container for holding product which may be used in conjunction with the applicators and applicator caps of the present invention.
Figure 48:
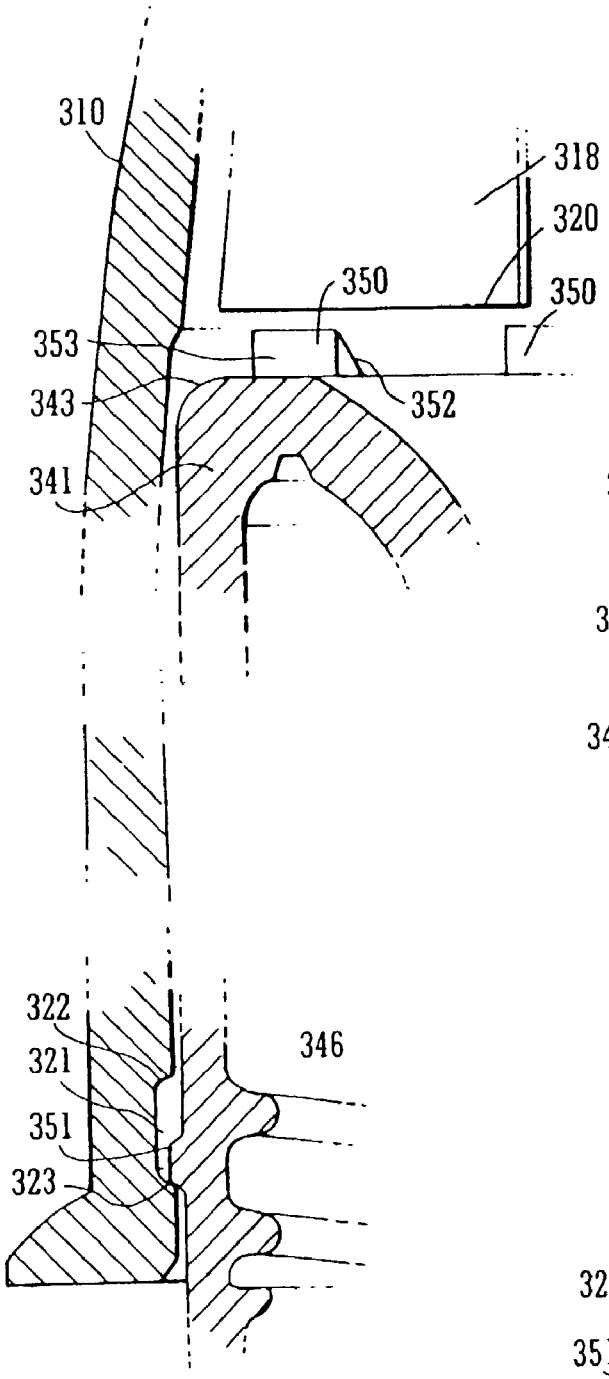
FIG. 48 shows a part-sectional view to enlarged scale of the overcap/undercap of FIG. 44 in a position where the relative axial freedom of the overcap and undercap allows for relative rotational movement of the overcap and undercap without unscrewing the cap assembly.
Figure 49:
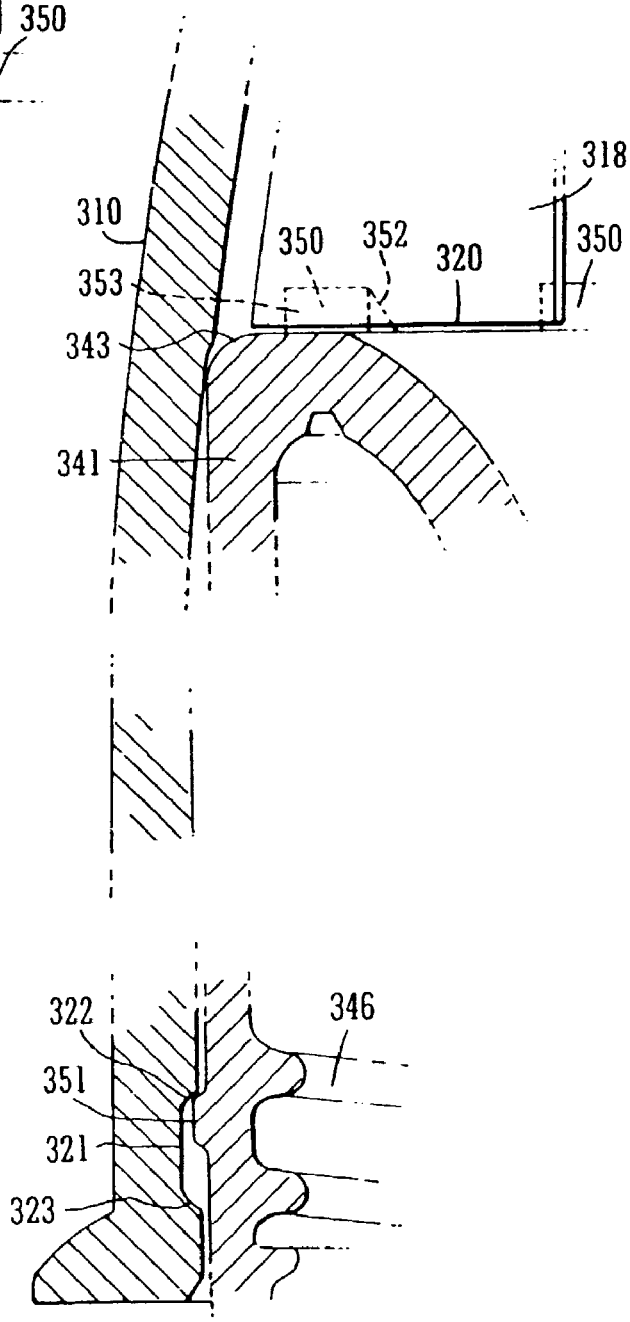
FIG. 49 shows the same view as FIG. 48, though in FIG. 49 the overcap and the undercap are positioned for screwing on the cap assembly.

In order to achieve unscrewing of the applicator cap assembly, sufficient downward force must be exerted on the overcap 310 causing the lower flat ends 320 of the respective teeth 318 within the housing of the overcap to abut the top wall 343 at respective positions between the teeth 350 and to engage with the teeth 350 at the junction of the oblique (ramp) surface 352 and the top wall as best seen from FIGS. 48-49. The teeth 350 are generally formed so that they have a substantially right angled triangular shape in cross-section. The oblique face of the right angle triangle is faced towards the direction of unscrewing of the applicator cap assembly. The cap assembly is however easily screwed onto the container, as best seen in FIGS. 44 and 49, the teeth 318 easily engage with the rear face 353 of the teeth 350 so that in the normal relative positions of the overcap and the undercap the two sets of teeth will interengage. The interengaged position is the normal rest position of the overcap and the undercap. When however the overcap is twisted in the direction of unscrewing the cap assembly the screw threading of the undercap to the container neck is sufficient to hold the undercap against relative rotation (to the container) so that the teeth 318 clip the junction of the oblique face 352 and the top wall 343 of the undercap, but do not interengage tending to be directed up the oblique face of the teeth 350 and slipping along its surface. There is however sufficient gripping surface or bite on the leading edges of the teeth 350 to allow the teeth 318 to engage the teeth 350 (at the junction of the teeth 350) when downward (axial) force is applied and sufficient torque is used to unscrew the under cap from the container. While the maximum clearance between the two sets of teeth of the embodiment shown in FIG. 38 is illustrated with an axial spacing between the teeth it will be appreciated that an axial freedom which allows a minimal clearance between the two sets of teeth is all that is required. The extent of relative axial movement is shown by the positions of FIGS. 48 and 49. In FIG. 48 the rim 351 abuts the lower edge 323 of the groove 321 as the overcap is in a raised position relative to the undercap. In FIG. 49 the overcap is in a lowered position where the teeth 318 (see also FIG. 44) abut the top wall 343 of the undercap at positions between the teeth 350. In the position of FIG. 49 the rim 351 on the undercap has moved also to its upper limit abutting edge 322 of the groove 321 of the overcap.

The applicator cap assembly can be screwed on to any desirable container—for example the tubular container of FIG. 38 and the holder of FIGS. 39/40. It will be appreciated that in such a container the orientation of the grips 237, 238 relative to the container can be selected by positioning the on the undercap at a desired position. The two sets of teeth act to hold the overcap and undercap in the desired position. To aid prevention of off-centre movement of the overcap a further rim could be provided either on the exterior of the undercap or the interior of the overcap to help prevent such motion by limiting the degree of off-centre movement available to the overcap. It will be appreciated that the overcap 220 of FIGS. 34-37 could also be used in the safety-cap embodiments of the invention just described. Provided that if an overcap 220 of FIGS. 34-37 is used the undercap 340 does not engage in any way with the teeth 239 on the overcap of FIGS. 34-37 relative rotation of the overcap and the undercap will not be prevented. This use of the overcap 220 can be accommodated for example by not providing teeth 210 (as shown in FIG. 31) of the exterior of the undercap body. The overcap is thus interchangeable between these alternative embodiments.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A package for holding curable cyanoacrylate product comprising:

(i) a container for holding curable cyanoacrylate product;

(ii) the applicator cap assembly for closing an container; and (iii) a curable cyanoacrylate adhesive in flowable form held within the container; the applicator cap assembly comprising:

(a) an undercap having an undercap body with a top end and with at least one endless side wall depending from the top end to form a housing for receiving the neck of a container;

(b) an overcap having an overcap body with a top end and with at least one endless side wall depending from the top end to form a housing for receiving and engaging the undercap; and (c) an applicator having a stem with a first end for engagement with, or integrally formed with, the undercap within the housing, so that the stem projects from the housing, and a second free end for applying the curable cyanoacrylate adhesive;

the exterior of the undercap body having a series of circumferentially arranged teeth for interengagement with a corresponding series of circumferentially arranged teeth within the housing of the overcap, one series of teeth projecting radially outwardly the other series of teeth projecting radially inwardly, the two series of teeth being interengageable at a number of relative positions, so that the relative orientation of the overcap to the undercap can be selected, and thus the relative orientation of the overcap to the container can be selected, wherein the overcap further comprises two opposing grips projecting from the exterior of the body of the overcap, wherein the grips take the form of two opposing wings, wherein the container is a tubular container and wherein the pack further comprises a holder which forms a support stand that immovable fixes the tubular container in only a single inclined position.

2. A package according to claim 1, wherein the teeth on the exterior body of the undercap project radially outwardly while those within the housing project radially inwardly.

3. A package according to claim 2, wherein the undercap and the overcap are snap-fit engagable with each other and the snap-fit is a non-return snap-fit to lock the parts together.

4. A package according to claim 1 wherein the container is provided with an anti-drip ring intermediate a container opening and a container screw thread, the anti-drip ring having a v shaped junction.

5. A package for holding a hardenable product in flowable form, comprising:

a holder having a body formed by a wall defining an interior space, the wall extending between a base end and an opposing top end, the top end having a rim portion defining an aperture connecting to the interior space, the rim portion including an engagement portion;

a container having a body with an internal cavity, a closed base and an opposing shoulder end defining an aperture connecting to the internal cavity, a tubular neck projecting longitudinally from the shoulder end and terminating at an upper rim, the neck having an internal conduit extending from the upper rim and connecting to the internal cavity, a screw thread disposed on the neck, an engagement portion intermediate the shoulder end and the screw thread;

wherein the container is disposed in the holder interior space, the container engagement portion is interlocked with the holder engagement portion to immovably fix the container to the holder, and the container neck extends through the holder rim aperture;

a cap having a screw thread removably engagable with the container screw thread and a sealing structure to seal the container internal cavity, the cap comprising:

an overcap having a body with a top end, an opposing bottom end defining an aperture therein, an internal wall connecting to the aperture and defining an internal cavity, the internal wall forming an engagement portion;

an applicator comprising a head having an upper surface, an opposing lower surface, an exterior wall intermediate and connecting the upper and lower surfaces, an engagement portion selectively engagable with the overcap engagement portion so that the rotational orientation of the overcap to the head can be selected, and a stem connected to the head with a free end for applying the hardenable product extending beyond the lower surface, the applicator head disposed within the overcap cavity, the overcap engagement portion immovable interengaged with the head engagement portion;

wherein the stem free end is disposed through the neck internal conduit into the container when the cap screw thread is engaged with the container screw thread, wherein the holder wall completely surrounds the holder interior space.

6. The package of claim 5, wherein the cap screw thread projects radially inwardly from the overcap internal wall.

7. The package of claim 5, wherein the head engagement portion comprises a plurality of circumferentially arranged teeth, and the overcap engagement portion comprises a plurality of circumferentially arranged teeth, one series of teeth projecting radially outwardly the other series of teeth projecting radially inwardly, the two series of teeth being interengageable at a number of relative positions prior to the overcap engagement portion being immovable interengaged with the head engagement portion.

8. The package of claim 5, wherein the overcap further comprises two diametrically opposed grips projecting radially outwardly from the body of the overcap.

9. A package for holding a hardenable product in flowable form, comprising:

a holder having a body formed by a wall defining an interior space, the wall extending between a base end and an opposing top end, the top end having a rim portion defining an aperture connecting to the interior space, the rim portion including an engagement portion;

a container having a body with an internal cavity, a closed base and an opposing shoulder end defining an aperture connecting to the internal cavity, a tubular neck projecting longitudinally from the shoulder end and terminating at an upper rim, the neck having an internal conduit extending from the upper rim and connecting to the internal cavity, a screw thread disposed on the neck, an engagement portion intermediate the shoulder end and the screw thread;

wherein the container is disposed in the holder interior space, the container engagement portion is interlocked with the holder engagement portion to immovably fix the container to the holder, and the container neck extends through the holder rim aperture;

a cap having a screw thread removably engagable with the container screw thread and a sealing structure to seal the container internal cavity, the cap comprising:

an overcap having a body with a top end, an opposing bottom end defining an aperture therein, an internal wall connecting to the aperture and defining an internal cavity, the internal wall forming an engagement portion;

an applicator comprising a head having an upper surface, an opposing lower surface, an exterior wall intermediate and connecting the upper and lower surfaces, an engagement portion selectively engagable with the overcap engagement portion so that the rotational orientation of the overcap to the head can be selected, and a stem connected to the head with a free end for applying the hardenable product extending beyond the lower surface, the applicator head disposed within the overcap cavity, the overcap engagement portion immovable interengaged with the head engagement portion;

wherein the stem free end is disposed through the neck internal conduit into the container when the cap screw thread is engaged with the container screw thread, wherein the container is immovably fixed in a single inclined position.

10. The package of claim 5, wherein the holder comprises a neck portion projecting angularly from the holder body.

11. A package for holding a hardenable product in flowable form, comprising:

a holder having a body formed by a wall defining an interior space, the wall extending between a base end and an opposing top end, the top end having a rim portion defining an aperture connecting to the interior space, the rim portion including an engagement portion;

a container having a body with an internal cavity, a closed base and an opposing shoulder end defining an aperture connecting to the internal cavity, a tubular neck projecting longitudinally from the shoulder end and terminating at an upper rim, the neck having an internal conduit extending from the upper rim and connecting to the internal cavity, a screw thread disposed on the neck, an engagement portion intermediate the shoulder end and the screw thread;

wherein the container is disposed in the holder interior space, the container engagement portion is interlocked with the holder engagement portion to immovably fix the container to the holder, and the container neck extends through the holder rim aperture;

a cap having a screw thread removably engagable with the container screw thread and a sealing structure to seal the container internal cavity, the cap comprising:

an overcap having a body with a top end, an opposing bottom end defining an aperture therein, an internal wall connecting to the aperture and defining an internal cavity, the internal wall forming an engagement portion;

an applicator comprising a head having an upper surface, an opposing lower surface, an exterior wall intermediate and connecting the upper and lower surfaces, an engagement portion selectively engagable with the overcap engagement portion so that the rotational orientation of the overcap to the head can be selected, and a stem connected to the head with a free end for applying the hardenable product extending beyond the lower surface, the applicator head disposed within the overcap cavity, the overcap engagement portion immovable interengaged with the head engagement portion;

wherein the stem free end is disposed through the neck internal conduit into the container when the cap screw thread is engaged with the container screw thread, comprising a drip ring intermediate the container upper rim and screw thread, the drip ring having a v shaped junction.

12. The package of claim 5, wherein the applicator engagement portion comprises a plurality of teeth axially projecting from the head upper surface.

13. A package for holding a hardenable product in flowable form, comprising:

a holder having a body formed by a wall defining an interior space, the wall extending between a base end and an opposing top end, the top end having a rim portion defining an aperture connecting to the interior space, the rim portion including an engagement portion;

a container having a body with an internal cavity, a closed base and an opposing shoulder end defining an aperture connecting to the internal cavity, a tubular neck projecting longitudinally from the shoulder end and terminating at an upper rim, the neck having an internal conduit extending from the upper rim and connecting to the internal cavity, a screw thread disposed on the neck, an engagement portion intermediate the shoulder end and the screw thread;

wherein the container is disposed in the holder interior space, the container engagement portion is interlocked with the holder engagement portion to immovably fix the container to the holder, and the container neck extends through the holder rim aperture;

a cap having a screw thread removably engagable with the container screw thread and a sealing structure to seal the container internal cavity, the cap comprising:

an overcap having a body with a top end, an opposing bottom end defining an aperture therein, an internal wall connecting to the aperture and defining an internal cavity, the internal wall forming an engagement portion;

an applicator comprising a head having an upper surface, an opposing lower surface, an exterior wall intermediate and connecting the upper and lower surfaces, an engagement portion selectively engagable with the overcap engagement portion so that the rotational orientation of the overcap to the head can be selected, and a stem connected to the head with a free end for applying the hardenable product extending beyond the lower surface, the applicator head disposed within the overcap cavity, the overcap engagement portion immovable interengaged with the head engagement portion;

wherein the stem free end is disposed through the neck internal conduit into the container when the cap screw thread is engaged with the container screw thread, wherein the holder rim portion comprises a plurality of angularly spaced, inwardly extending segments separated by a plurality of angularly spaced seats; and the container engagement portion comprises a plurality of angularly spaced, outwardly extending tabs separated by a plurality of angularly spaced recesses, each container tab disposed in a respective holder seat and each holder segment disposed in a respective container recess.

14. A package for holding a hardenable product in flowable form, comprising:

a holder having a body formed by a wall defining an interior space, the wall extending between a base end and an opposing top end, the top end having a rim portion defining an aperture connecting to the interior space, the rim portion including an engagement portion;

a container having a body with an internal cavity, a closed base and an opposing shoulder end defining an aperture connecting to the internal cavity, a tubular neck projecting longitudinally from the shoulder end and terminating at an upper rim, the neck having an internal conduit extending from the upper rim and connecting to the internal cavity, a screw thread disposed on the neck, an engagement portion intermediate the shoulder end and the screw thread;

wherein the container is disposed in the holder interior space, the container engagement portion is interlocked with the holder engagement portion to immovably fix the container to the holder, and the container neck extends through the holder rim aperture;

a cap having a screw thread removably engagable with the container screw thread and a sealing structure to seal the container internal cavity, the cap comprising:

an overcap having a body with a top end, an opposing bottom end defining an aperture therein, an internal wall connecting to the aperture and defining an internal cavity, the internal wall forming an engagement portion;

an applicator comprising a head having an upper surface, an opposing lower surface, an exterior wall intermediate and connecting the upper and lower surfaces, an engagement portion selectively engagable with the overcap engagement portion so that the rotational orientation of the overcap to the head can be selected, and a stem connected to the head with a tree end for applying the hardenable product extending beyond the lower surface, the applicator head disposed within the overcap cavity, the overcap engagement portion immovable interengaged with the head engagement portion;

wherein the stem free end is disposed through the neck internal conduit into the container when the cap screw thread is engaged with the container screw thread, wherein:

the holder rim portion comprises a plurality of angularly spaced, inwardly extending segments separated by a plurality of angularly spaced sears, and an inwardly extending grip angularly aligned with and disposed below a seat;

the container engagement portion comprises a plurality of angularly spaced, outwardly extending tabs separated by a plurality of angularly spaced recesses;

each container tab disposed in a respective holder seat, each holder segment disposed in a respective container recess, the grip preventing movement of the container toward the holder base end and the segment preventing movement of the container shoulder past the holder rim portion.

15. The package of claim 5, wherein the neck internal conduit comprises a diametrically reduced portion to wipe the applicator stem as it moves through the diametrically reduced portion.

16. The package of claim 5, comprising an insert disposed in the container neck and extending beyond the upper rim, the insert having an internal passage with a diametrically reduced portion, wherein the applicator stem is wiped as it moves through the diametrically reduced portion.

17. A package for holding a hardenable product in flowable form, comprising:

a holder having a body formed by a wall substantially surrounding an interior space, the wall extending between a base end and an opposing top end, the base end defining an aperture therein connecting to the interior space, the top end having a rim portion defining an aperture connecting to the interior space, the rim portion comprising a plurality of angularly spaced, inwardly extending segments separated by a plurality of angularly spaced seats, and an inwardly extending grip angularly aligned with and disposed below a seat;

a container having a body with an internal cavity, a closed base and an opposing shoulder end defining an aperture connecting to the internal cavity, a tubular neck projecting longitudinally from the shoulder end and terminating at an upper rim, the neck having an internal conduit extending from the upper rim and connecting to the internal cavity, a screw thread disposed on the neck, a drip ring intermediate the upper rim and the screw thread, the drip ring having a v shaped junction, and an annular collar extending outwardly from the container, the collar comprising a plurality of angularly spaced tabs separated by a plurality of angularly spaced, closed bottomed recesses;

wherein the container is disposed in the holder interior space and the container neck extends through the holder rim aperture, each container tab is disposed in a respective holder seat, each holder segment disposed in a respective container recess, the grip preventing movement of the tab toward the holder base end, the segment preventing movement of the recess bottom past the holder rim portion and the segment preventing rotational movement of the collar so that the container is immovably fixed to the holder;

a cap having a screw thread removably engagable with the container screw thread and a sealing structure to seal the container internal cavity, the cap comprising:

an overcap having a body with a top end, an opposing bottom end defining an aperture therein, an internal wall connecting to the aperture and defining an internal cavity, the internal wall comprising a plurality of circumferentially arranged teeth;

an applicator comprising a head having an upper surface, an opposing lower surface, an exterior wall intermediate and connecting the upper and lower surfaces, the exterior wall comprising a plurality of circumferentially arranged teeth selectively engagable with the overcap teeth so that the rotational orientation of the overcap with respect to the head can be selected, and a stem connected to the head with a free end for applying the hardenable product extending beyond the lower surface, the applicator head disposed within the overcap cavity, the overcap engagement portion immovable interengaged with the head engagement portion;

wherein the stem free end is disposed through the neck internal conduit into the container when the cap screw thread is engaged with the container screw thread.

18. The package of claim 17, wherein the holder comprises a neck portion intermediate the rim portion and the body, the neck portion projecting angularly from the holder body.

* * * * *